US005273859A

United States Patent [19]

Katoh et al.

[11] Patent Number: 5,273,859

[45] Date of Patent: Dec. 28, 1993

[54] SILVER HALIDE PHOTOGRAPHIC MATERIAL AND IMAGE FORMING METHOD USING THAT MATERIAL

[75] Inventors: Kazunobu Katoh; Hisashi Okamura; Morio Yagihara, all of Kanagawa, Japan

[73] Assignee: Fuji Photo Film Co., Ltd., Kanagawa, Japan

[21] Appl. No.: 763,702

[22] Filed: Sep. 23, 1991

[30] Foreign Application Priority Data

Sep. 28, 1990 [JP] Japan ..... 2-258924

[51] Int. Cl.[5] ..... G03C 1/06; G03C 5/26

[52] U.S. Cl. ..... 430/264; 430/223; 430/564; 430/598; 430/957

[58] Field of Search ..... 430/264, 223, 544, 957, 430/564, 598

[56] References Cited

U.S. PATENT DOCUMENTS

| | | | |
|---|---|---|---|
| 4,477,563 | 10/1984 | Ichijima et al. | 430/544 |
| 4,684,604 | 8/1987 | Harder | 430/223 |
| 4,782,012 | 11/1988 | DeSelms et al. | 430/223 |
| 5,085,971 | 2/1992 | Katoh et al. | 430/544 |
| 5,132,201 | 7/1992 | Yagihara et al. | 430/264 |
| 5,134,055 | 7/1992 | Okamura et al. | 430/264 |

FOREIGN PATENT DOCUMENTS 0393720 10/1990 European Pat. Off. .
0395069 10/1990 European Pat. Off. .

OTHER PUBLICATIONS

European Search Report 91 11 6544, Jan. 20, 1992, A. J. Buscha, The Hague.

The Journal of Photographic Science, vol. 35, No. 5, Sep. 1987, "An Improved Process for Hydrazine-Promoted Infectious Development of Silver Halide".

*Primary Examiner*—Richard L. Schilling

*Attorney, Agent, or Firm*—Sughrue, Mion, Zinn, Macpeak & Seas

[57] ABSTRACT

A method for forming an image is disclosed. The method comprises the step of developing an imagewise exposed silver halide photographic material which contains a redox compound, with a developer which contains a silver halide developing agent and at least 0.1 mol/l of a sulfite and has a pH of 9 to 12, wherein the redox compound contains a redox group which is a hydrazine derivative which is capable of releasing a development inhibitor as a result of oxidation with the oxidized developer, and wherein after said oxidation, at least a portion of the development inhibitor is released into a developer where it reacts with a developer component and changes into a compound having little inhibiting effect. A silver halide photographic material used in that method is also disclosed.

11 Claims, 1 Drawing Sheet

SILVER HALIDE PHOTOGRAPHIC MATERIAL AND IMAGE FORMING METHOD USING THAT MATERIAL

FIELD OF THE INVENTION

The present invention relates to a silver halide photographic material and to a method for forming superhigh contrast negative images using this material. More particularly, the present invention relates to a superhigh contrast negative photographic material which is suitable as a silver halide photographic material to be employed in photomechanical processes.

BACKGROUND OF THE INVENTION

In the field of photomechanical processing, there is a demand for photographic materials with a good ability to reproduce originals, for stable processing solutions and for simple processing solution replenishment methods, etc., in order to cope with the diversity and complexity of printed matter.

In processes for line image photography in particular, original documents may be prepared by pasting up photoset characters, handwritten characters, illustrations and dot images, etc. These original documents may contain mixtures of images with different densities or line widths. There is therefore a strong demand for platemaking cameras, photographic materials and image forming methods that will permit good reproduction of such original documents.

Further, magnification (spread) and reduction (choke) of halftone photographs is a common practice in platemaking for catalogs and large posters. But in platemaking using enlargement of dots, the result is a coarsening of line counts and a photographing of blurred points. With reduction of dots, the result is photographing of an image in which the line/inch count is greater and the dots are finer than in the original. Therefore, there is a need for an image forming method that affords still greater latitude in order to ensure reproduction of halftone gradations.

Halogen lamps and xenon lamps are used as light sources for platemaking cameras. Normally the photographic material is orthosensitized in order to give the requisite photographic speed for these light sources. However, it has been found that orthosensitized photographic material is strongly affected by the chromatic aberration of lenses, and consequently image quality is likely to deteriorate. This deterioration is more marked with xenon-lamp light sources.

A known system for meeting the demand for wider latitude is one in which image portions and non-image portions are clearly distinguished. Further, line or dot images with a high contrast and a high blackening density are produced by a hydroquinone developer in which the effective concentration of sulfite ions is very low (usually 0.1 mol/l or less) to process lithographic silver halide light-sensitive materials comprising silver chlorobromides (with a silver chloride content of at least 50%). However, with this method, since the sulfite ion concentration is low, development is very unstable against air oxidation. Consequently, that method was used with a variety of adjustments made to keep the solution activity stable and the processing speed was very slow. This lowered working efficiency.

There has therefore been a demand for image forming systems which eliminate the instability in image formation that exists with development methods such as those described above (a lithographic development system), which effect development with a processing solution possessing a good storage stability, and which achieve superhigh contrast photographic characteristics. One such system comprises the formation of superhigh contrast negative images with a gamma greater than 10 by using a developer that has a pH of 11.0–12.3, contains 0.15 mol/l or more of sulfurous acid preservative and has a good storage stability to process surface latent image silver halide photographic material which contains specific acylhydrazine compounds, as seen in U.S. Pat. Nos. 4,166,742, 4,168,977, 4,221,857, 4,224,401, 4,243,739, 4,272,606 and 4,311,781. With earlier superhigh contrast image formation it was possible to use only silver chlorobromides with a high silver chloride content, and it is a feature of this new image forming system that it is also possible to use silver iodobromide and silver chloroiodobromide.

The above imaging system has an outstanding halftone quality, rapid and stable processing and good reproducibility of originals. But there is a demand for a system where the reproducibility of the original is further improved in order to cope with the recent diversity in printed matter.

JP-A-61-213847 (The term "JP-A" as used herein means an "unexamined published Japanese patent application") and U.S. Pat. No. 4,684,604 disclose light-sensitive materials containing redox compounds which release development inhibitors as a result of oxidation and describe an attempt to extend the range of gradation reproduction. However, if these redox compounds are added to light-sensitive materials in amounts sufficient to improve reproducibility of line images and dot images in a superhigh contrast processing system using hydrazine derivatives, an outflow of part of the development inhibitors released occurs at the time of development processing. Continued processing of large quantities of light-sensitive material containing these redox compounds results in gradual accumulation of development inhibitors in the developer, and when the exhausted developer that has been employed in processing is used in development processing, the result is hindrance of the achievement of high contrast and a fall in the photographic speed. In particular, if other light-sensitive photography materials contact light-sensitive materials, scanner light-sensitive materials or photographic light-sensitive materials, etc., are developed as well as the light-sensitive materials containing these redox compounds in a single automatic development unit, there is the problem of photographically adverse effects on these other light-sensitive materials.

Since there are restrictions on the amount of such redox compounds used, it is impossible to achieve thoroughly satisfactory effects and light-sensitive materials, and development processing solutions can be used only in a closed system that is restricted to a narrow range.

SUMMARY OF THE INVENTION

The present invention has as one object to provide a light-sensitive material for a photomechanical process which makes it possible to produce contrasty images using a highly stable developer and an image forming method using this material.

A second object is to provide a light-sensitive material for a photomechanical process, which is a contrasty light-sensitive material using a hydrazine nucleating agent and which gives a wide range of halftone gradation and an image forming method using this material.

A third object is to provide a light-sensitive material for a photomechanical process, which has good development processing running stability and an image forming method using this material.

The present invention achieves these and other objects by an image forming method which comprises the step of developing an imagewise exposed silver halide photographic material containing a redox compound, with a developer which contains a silver halide developing agent and at least 0.1 mol/l of a sulfite and has a pH of 9 to 12, wherein the redox compound contains a redox group which is a hydrazine derivative which is capable of releasing a development inhibitor as a result of oxidation with the oxidized developer, and wherein after said oxidation, at least a portion of that development inhibitor is released into a developer where it reacts with a developer component and changes into a compound having little inhibiting effect.

In more detail, the above objects are achieved by a silver halide photographic material which contains (i) a redox compound having, as a redox group, a hydrazine derivative which is capable of releasing a development inhibitor as a result of oxidation with the developer, at least a portion of the development inhibitor being released into a developer to react with a developer component and being capable of changing to a compound with little inhibiting effect, and (ii) a second hydrazine compound.

BRIEF DESCRIPTION OF THE DRAWINGS

FIG. 1(*a*) transparent or semitransparent film base;

FIG. 1(*b*) line image original document (the black portions indicate lines);

FIG. 1(*c*) transparent or semitransparent film base;

FIG. 1(*d*) dot image original document (the black portions indicate dots); and

FIG. 1(*e*) light-sensitive material for contact work (the slant line portion indicates a light-sensitive layer).

DETAILED DESCRIPTION OF THE INVENTION

Figures 1A, 1B, 1C, 1D, 1E:
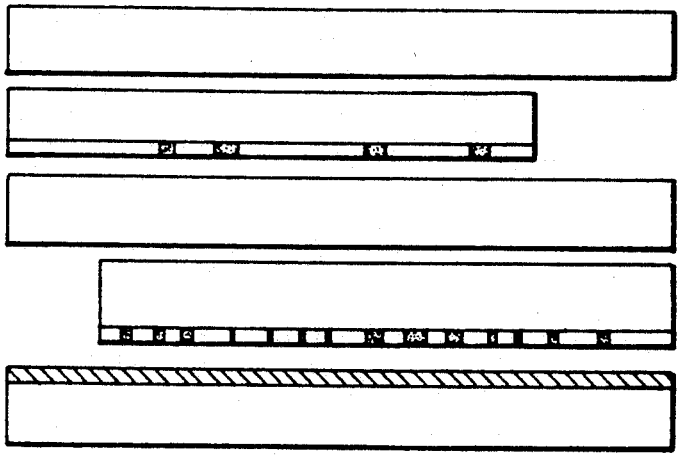
FIGS. 1(*a*) to 1(*e*) are cross-sectional views of the photographic material of this invention at the time of exposure in letter image formation by repeated contact work, the various layers being identified as follows.

Compounds represented by formulae (I), (II) and (III) below are preferably employed in the invention as the redox compounds:

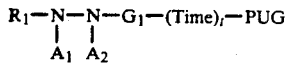

(I)

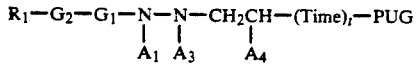

(II)

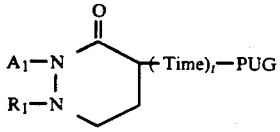

(III)

wherein $R_1$ represents an aliphatic group or an aromatic group;

$G_1$ represents a

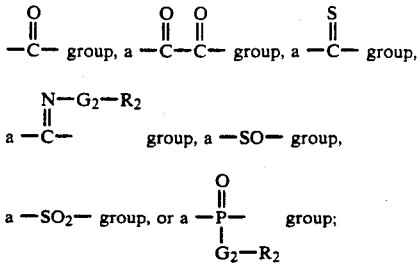

$G_2$ represents a single bond

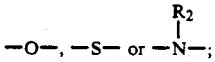

$R_2$ represents groups with the same definitions as for $R_1$ or a hydrogen atom, and if there is a plurality of $R_2$ groups in a molecule, they may be the same or different;

$A_1$ and $A_2$ each independently represents a hydrogen atom, an acyl group, an alkylsulfonyl group or an arylsulfonyl group provided that $A_1$ and $A_2$ are not both at the same time hydrogen atoms;

$A_3$ represents groups with the same definitions as for $A_1$ or $—CH_2CH(A_4)—(Time)_t—PUG$;

$A_4$ represents a nitro group, a cyano group, a carboxyl group, a sulfonyl group or $—G_1—G_2—R_1$, and if there is a plurality of $—G_1—G_2—R_1$ groups in a molecule, they may be the same or different;

Time represents a divalent linking group;

t represents 0 or 1; and

PUG represents a development inhibitor which, when it flows out into a developer, can react with a developer component and change into a compound having little inhibiting effect.

Aliphatic groups represented by $R_1$ in formulae (I), (II) and (III) are preferably those having 1 to 30 carbon atoms and more preferably they are straight-chain, branched or cyclic alkyl groups having 1 to 20 carbon atoms. These alkyl groups may have substituent groups.

Aromatic groups represented by $R_1$ in formulae (I), (II) and (III) are single-ring or double-ring aryl groups or unsaturated heterocyclic groups. The unsaturated heterocyclic groups in this case may combine with aryl groups to form fused rings.

For example, $R_1$ may be benzene, naphthalene, pyridine, quinoline and isoquinoline rings, etc. Among these, groups containing benzene rings are preferred.

Aryl groups are particularly preferred for $R_1$.

The alkyl groups, aryl groups or unsaturated heterocyclic groups represented by $R_1$ may be substituted by groups including alkyl, aralkyl, alkenyl, alkynyl, alkoxy, aryl, substituted amino, ureido, urethane, aryloxy, sulfamoyl, carbamoyl, alkylthio, arylthio, sulfonyl, sulfinyl and hydroxy groups, halogen atoms and cyano, sulfo, aryloxycarbonyl, acyl, alkoxycarbonyl, acyloxy, carboxamido, sulfonamido, carboxyl and amidophosphate groups. Preferred substituents include straight-chain, branched or cyclic alkyl groups (preferably having 1–20 carbon atoms), aralkyl groups (preferably having 7–30 carbon atoms), alkoxy groups (preferably having 1–30 carbon atoms), substituted amino groups (preferably amino groups in which there is a substitution by alkyl groups having 1–30 carbon atoms, and acylamino groups (preferably having 2–40 carbon atoms)), sulfonamido groups (preferably having 1–40 carbon atoms) and ureido groups (preferably having 1–40 carbon atoms), and amidophosphate groups (preferably having 1–40 carbon atoms).

The $$-\overset{O}{\overset{\|}{C}}- \text{ and } -SO_2- \text{ groups}$$

are preferred and the $$-\overset{O}{\overset{\|}{C}}- \text{ group}$$

is the most preferred as $G_1$ in formulae (I) and (II).

Acyl groups and alkylsulfonyl groups represented by $A_1$ or $A_2$ in formulae (I), (II) and (III) are preferably those having 12 or less carbon atoms.

Arylsulfonyl groups represented by $A_1$ or $A_2$ in formulae (I), (II) and (III) are preferably those having 18 or less carbon atoms.

Hydrogen atoms are preferred as $A_1$ and $A_2$.

The term Time in formulae (I), (II) and (III) represents a divalent linking group and it may possess a timing control function.

The divalent linking group represented by Time is one from which PUG is released in a reaction of one or more stages from the Time-PUG moiety that is released from an oxide of the parent nucleus by reduction-oxidation.

Examples of the divalent linking groups represented by Time include the groups disclosed in U.S. Pat. No. 4,248,962 (JP-A-54-145135), etc. which release PUG through an intramolecular ring-closure reaction of a p-nitrophenoxy derivative; the groups disclosed in U.S. Pat. Nos. 4,310,612 (JP-A-55-53330) and 4,358,525, etc. which release PUG through an intramolecular ring-closure reaction following ring cleavage; the groups disclosed in U.S. Pat. Nos. 4,330,617, 4,446,216 and 4,483,919 and JP-A-59-121328, etc. which release PUG in accompaniment with the formation of an acid anhydride through an intramolecular ring-closure reaction of the carboxyl groups of a succinic acid monoester or an analog thereof; the groups disclosed in U.S. Pat. Nos. 4,409,323 and 4,421,845, the *Journal Research Disclosure* No. 21228 (December, 1981), U.S. Pat. No. 4,416,977 (JP-A-57-135944), JP-A-58-209736 and JP-A-58-209738, etc. which release PUG through the formation of quinomonomethane or an analog thereof as a result of electron migration through a double bond with a conjugated aryloxy group or a heterocyclic oxy group; the groups disclosed in U.S. Pat. No. 4,420,554 (JP-A-57-136640), JP-A-57-135945, JP-A-57-188035, JP-A-58-98728 and JP-A-58-209737, etc. which release PUG from an enamine γ-position as a result of electron migration of a portion of a nitrogen-containing heterocyclic ring that possesses an enamine structure; the groups disclosed in JP-A-57-56837 which release PUG through intramolecular ring-closure reactions of oxy groups produced as a result of electron migration to carbonyl groups conjugated with the nitrogen atoms of nitrogen-containing heterocyclic groups; the groups disclosed in U.S. Pat. No. 4,146,396 (JP-A-52-90932), JP-A-59-93442, JP-A-59-75475, JP-A-60-249148 and JP-A-60-249149, etc. which release PUG in accompaniment with aldehyde formation; the groups disclosed in JP-A-51-146828, JP-A-57-179842 and JP-A-59-104641 which release PUG in accompaniment with decarboxylation; groups which have an —O—COOCR$_a$R$_b$—PUG structure (where $R_a$ and $R_b$ represent monovalent groups such as a hydrogen atom, an alkyl group, an aryl group, an acyl group, an alkylsulfonyl group, and an arylsulfonyl group) and release PUG in accompaniment with aldehyde formation following decarboxylation; the groups disclosed in JP-A-60-7429 which release PUG in accompaniment with isocyanate formation; and the groups disclosed in U.S. Pat. No. 4,438,193, etc. which release PUG through a coupling reaction with color developer oxides.

Examples of these divalent linking groups represented by Time are also described in detail in JP-A-61-236549, JP-A-1-269936 and Japanese Patent Application No. 2-93487, etc.

PUG is a development inhibitor which can change into a compound with only a slight inhibiting effect when it flows out into a developer and reacts with developer components. Preferably, PUG in formula (I) possesses hetero-atoms (e.g., nitrogen, sulfur, oxygen) and is bonded via these atoms to $$R_1-\underset{\underset{A_1}{|}}{N}-\underset{\underset{A_2}{|}}{N}-G_1-(\text{Time})_t-$$

of formula (I).

PUG in the invention has as its partial structure a development inhibiting portion, a portion which is released from $G_1$ or Time, and a portion which reacts with components in a developer and weakens the effect of the development inhibiting portion.

These partial structures may more than one of these functions. For example, the development inhibiting portion may also serve as the portion that is released from $G_1$ or Time.

A known development inhibitor may be employed directly in unmodified form as the development inhibiting portion used in PUG.

Examples of these known development inhibitors are noted in *The Theory of the Photographic Process*, 4th edition, 1977, by T. H. James, published by Macmillan, pages 396–399 and on pages 56–69 of Japanese Patent Application No. 2-93487.

Preferably, the development inhibiting portions are substituted, examples of these substituents being the substituents noted as the $R_1$ substituents, and these groups may be further substituted. Further, it is preferable that the substituent portions or portions of the main development inhibitor itself react with developer components to change PUG as whole into a compound which has little inhibiting effect.

The term "inhibiting effect" with respect to the development inhibitor as used herein means the degree of reduction of photographic sensitivity in development processing. Specifically, the development inhibitor has the function of inhibiting the development of light-sensitive emulsion layer while the development inhibitor partially flows out into a developer. Therefore, if a large amount of the development inhibitor-releasing redox compounds is subjected to development processing, the development inhibitor is accumulated in the developer. As a result, when a development processing is carried out by using such a fatigued developer, the reduction of photographic sensitivity would be caused.

When the compound of the present invention is used, the reduction of photographic sensitivity in the processing using a fatigued developer is reduced to not larger than one-half, preferably not larger than one-third the reduction of photographic sensitivity when the compound of the present invention is not used.

The rate of change to a compound having little inhibiting effect varies depending on the pH of the developer, the volume of developer in the development unit, the amount of light-sensitive material processed and the processing speed, etc., but the half-value period is within 24 hours and preferably within 8 hours.

Preferably, the development inhibitor represented by PUG that is used in the invention is a compound that inhibits nucleating infectious development.

"Nucleating infectious development" is a new form of development chemistry which is used in the image forming method of the Fuji Film GRANDEX system (Fuji Photo Film Co., Ltd.) and the Kodak Ultratec system (Eastman Kodak Co. Ltd.). As explained in the *Journal of the Japan Institute of Photographic Science,* Vol. 52, No. 5, pages 390–394 (1989) and the *Journal of Photographic Science,* Vol. 35, page 162 (1987), this development chemistry consists of (i) a stage of development of exposed silver halide grains by an ordinary developing agent and (ii) a stage in which active nucleation seeds are formed as a result of cross-oxidation of a nucleation agent and developer oxides produced in the first stage. These active seeds bring about nucleating infectious development of peripherally unexposed - weakly exposed silver halide grains.

Thus, since the development process as a whole consists of an ordinary development stage together with a nucleation development stage, as well as the possible use of a conventionally-known ordinary development inhibitor, it is also possible to take full advantage of the inhibiting effects of a compound which inhibits a nucleating infectious development stage. This latter compound will be called a "nucleation development inhibitor" here.

The development inhibitor represented by PUG that is used in the present invention is preferably a nucleation development inhibitor. Even conventionally-known development inhibitors display effects as nucleation development inhibitors, and particularly effective compounds are those possessing one or more nitro groups or nitroso groups, compounds possessing pyridine, pyrazine, quinoline or similar nitrogen-containing heterocyclic skeletons, especially 6-member heteroaromatic skeletons, compounds possessing N-halogen bonds, quinones, tetraazolium compounds, amine oxides, azoxy compounds and coordination compounds possessing oxidation capability.

Among these, compounds possessing nitro groups and compounds having a pyridine skeleton are particularly effective.

Other effective nucleation development inhibitors are those that are adsorbable on silver halide grains and possess anionic charge groups or dissociable groups that can be dissociated in a developer and produce anionic charges.

Examples of these nucleation development retardation portions are given below:

1. Compounds possessing nitro groups (including compounds with all types of substitution positions):
(1) Nitrobenzene, nitrotoluene
(2) Dinitrobenzene, dinitrotoluene
(3) Nitrobenzoic acid esters
(4) Dinitrobenzoic acid esters
(5) Nitrobenzoic acid amides
(6) Dinitrobenzoic acid amides
(7) Nitronaphthalene
(8) Nitropyrazole
(9) Nitroimidazole
(10) Nitropyrrole
(11) Mono or dinitroindole
(12) Mono or dinitroindazole
(13) Mono or dinitrobenzimidazole
(14) Nitrobenzotriazole
(15) Nitropyridine
(16) Nitropyrimidine
(17) Nitrobenzothiazole
(18) Nitrobenzoxazole
(19) Nitroquinoline
(20) Nitrotetraazaindene 2. Compounds possessing nitroso groups (including compounds with all types of substitution positions)
(1) Nitrosobenzene, dinitrosobenzene
(2) Nitrosonaphthalene, dinitrosonaphthalene
(3) Nitrosopyridine
(4) Nitrosopyrimidine
(5) N-Nitrosoaniline
(6) N-Nitrosoacetoanilide
(7) N-Nitroso-2-oxazolidone
(8) N-Nitroso-N-benzyl, toluenesulfonamide 3. Nitrogen-containing heterocyclic rings
(1) Pyridine
(2) Nicotinic acid esters, amides
(3) Isonicotinic acid esters, amides
(4) Pyrazine
(5) Indolidine
(6) Quinolidine
(7) Quinoline
(8) Isoquinoline
(9) Phthalazine
(10) Naphthidine
(11) Quinoxaline
(12) Quinazoline
(13) Phthalidine
(14) Carbazole
(15) Phenanthridine
(16) Acridine
(17) Phenanthroline
(18) Phenathidine
(19) Phenothiazine
(20) Phenarsazine 4. Compounds possessing N-halogen bonds
(1) N-Chlorosuccinic acid imides 5. Quinones
(1) Benzoquinone
(2) Chlorobenzoquinone
(3) Naphthoquinone
(4) Anthraquinone 6. Tetrazolium compounds
(1) 2,3,5-Triphenyltetrazolium chloride 7. Amine oxides
(1) Pyridine oxide
(2) Quinoline oxide 8. Azoxy compounds
(1) Azoxybenzene 9. Coordination compounds possessing oxidation capability
(1) EDTA-Fe(III) complexes It is useful if the nucleation development inhibitors used in the present invention contain one of the above examples of compounds or other development inhibitor structures as part of their structures. Further, the nucleation development inhibitors used in the present invention may be substituted. Preferred substituents are, for example, those listed below, and these groups may be further substituted.

The substituents include alkyl, aralkyl, alkenyl, alkynyl, alkoxy, aryl, substituted amino, acylamino, sulfonylamino, ureido, urethane, aryloxy, sulfamoyl, carbamoyl, alkylthio, arylthio, sulfonyl, sulfinyl and hydroxy groups, halogen atoms and cyano, sulfo, alkyloxycarbonyl, aryloxycarbonyl, acyl, alkoxycarbonyl, acyloxy, carbonamido, sulfonamido, carboxyl, sulfoxy and phosphono groups, phosphinic acid groups and amidophosphate groups.

Particularly preferred compounds among the compounds represented by formula (I) are the compounds represented by the following formula (IV):

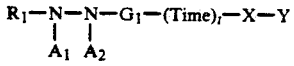

(IV)

wherein $R_1$ $G_1$, $A_1$, $A_2$, Time and t have the same definitions as in formula (I);

X represents a divalent group containing a nitro group as a substituent or a portion of a substituent or a divalent group possessing a pyridine ring in part of its structure; and Y represents a monovalent group which can react with a developer component and change into an anionic functional group.

The description given in relation to formula (I) applies also to $R_1$, $G_1$, $A_1$ and $A_2$ of formula (IV).

Time in formula (IV) represents a divalent linking group and it may have a timing control function.

The divalent linking group represented by Time indicates a group from which X—Y is released in a reaction of one or more stages from the Time —X—Y that is released from an oxide of the parent nucleus by reduction-oxidation.

The groups cited as examples in the detailed description of formula (I) are also specific examples of the divalent linking groups represented by Time here.

Divalent groups represented by X in formula (IV) possess hetero-atoms and are bonded via these hetero-atoms to the

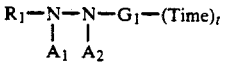

portion of formula (IV).

The group represented by —X—Y in formula (IV) is a development inhibitor and is preferably a nucleation development inhibitor.

The groups represented by —X—Y in formula (IV) are preferably represented by the following formula (V) or formula (VI).

Formula (V) is shown below.

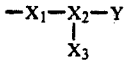

(V)

In formula (V), $X_1$ represents —O—, —S—, —Se—, —Te— or

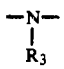

and $R_3$ is a hydrogen atom or a group with the same definition as $R_1$ in formula (I). $X_2$ is an aliphatic group, an aromatic group or a trivalent group formed through a combination of these groups with

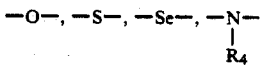

($R_4$ having the same definition as $R_3$),

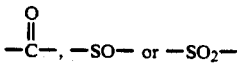

and $X_2$ may be substituted. In this case, the substituents cited as examples of the $R_1$ substituents in formula (I) are examples of preferred substituents. $X_3$ represents a nitro group or a pyridine group. If $X_3$ is a pyridine group, it may condense to a ring with a ring other than $X_3$ and it may also be substituted. In this case again, the substituents cited as examples of the $R_1$ substituents in formula (I) are examples of preferred substituents.

Y has the same definition as in formula (IV) and may be linked to $X_3$, not $X_2$, if $X_3$ is a pyridine group. (In this case, $X_2$ is a divalent group or it may be a single bond.)

If $X_3$ is a nitro group, preferably $X_2$ contains an aromatic ring as part of its structure and preferably $X_3$ is linked to this aromatic ring portion.

Formula (VI) is shown below

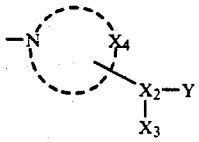

(VI)

In formula (VI), $X_2$, $X_3$ and Y have the same definitions as in formula (V), and $X_4$ represents a group of nonmetallic atoms necessary for forming a nitrogen-containing heterocyclic ring with the nitrogen atom in formula (VI).

Y may be linked to $X_4$, not $X_2$, regardless of whether $X_3$ is a pyridine group or a nitro group. (In this case, $X_2$ is a divalent group, or it may be a single bond.) Further, the linkage may be with $X_3$, not $X_2$, if $X_3$ is a pyridine group. (In this case, $X_2$ is a divalent group, or it may be a single bond.)

If $X_3$ is a nitro group, preferably $X_2$ contains an aromatic ring as part of its structure and preferably $X_3$ is linked to this aromatic ring portion. Also, if $X_3$ is a nitro group, Y is preferably linked to $X_4$, and in this case $X_2$ is preferably a single bond.

Preferably, the nitrogen-containing heterocyclic group represented by

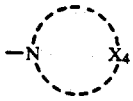

in formula (VI) is a heterocyclic aromatic ring.

Further, the heteroaromatic group represented by

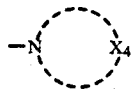

in formula (VI) is preferably a 5- to 6-member ring. Even if it is a single ring, it may be ring-condensed with another ring or it may be substituted.

Examples of preferred heteroaromatic rings include pyrrole, imidazole, pyrazole, 1,2,3-triazole, 1,2,4-triazole, tetrazole, 2-thioxathiazoline, 2-oxathiazoline, 2-thioxaoxazoline, 2-oxaoxazoline, 2-thiooxaimidazoline, 2-oxaimidazoline, 3-thioxa-1,2,4-triazoline, 3-oxa-1,2,4-triazoline, 1,2-oxazoline-5-thione, 1,2-thiazoline-5-thione, 1,2-oxazolin-5-one, 1,2-thiazolin-5-one, 2-thioxa-1,3,4-thiadiazoline, 2-oxa-1,3,4-thiadiazoline, 2-thioxa-1,3,4-oxadiazoline, 2-oxa-1,3,4-oxadiazoline, 2-thioxadihydropyridine, 2-oxadihydropyridine, 4-thioxadihydropyridine, 4-oxadihydropyridine, isoindole, indole, indazole, benzotriazole, benzimidazole,2-thioxabenzimidazole, 2-oxabenzimidazole, benzoxazoline-2-thione, azaindenes, benzoxazolin-2-one, benzothiazoline-2-thione, benzothiazolin-2-one, carbazole, purine, carboline, phenoxazine, phenothiazine and, in various fused ring positions, pyrazolopyridines, pyrazolopyrimidines, pyrazolopyrroles, pyrazolopyrazoles, pyrazoloimidazoles, pyrazoloxazoles, pyrazolothiazoles, pyrazolotriazoles, imidazolopyridines, imidazolopyrimidines, imidazolopyrroles, imidazoloimidazoles, imidazoloxazoles, imidazolothiazoles and imidazolotriazoles.

Preferred heterocyclic aromatic rings include, for example, pyrrole, imidazole, pyrazole, triazole, tetrazole, 2-thioxathiazoline, 2-thioxaoxazoline, indole, indazole, benzotriazole, benzimidazole, 2-thioxa-1,3,4-thiadiazoline, azaindene, 5-thioxatetrazoline, 2-thioxa-1,3,4-oxadiazoline, 3-thioxa-1,2,4-triazoline and, in various fused ring positions, pyrazolopyridines and pyrazoloimidazoles, etc. Heterocyclic aromatic rings such as pyrazoles, indazoles and pyrazolopyridines which include a pyrazole skeleton are particularly preferred.

These heterocyclic compounds may possess substituents, which include mercapto, nitro, carboxyl, sulfo, phosphono, hydroxy, alkyl, aralkyl, alkenyl, alkynyl, aryl, alkoxy, aryloxy, amino, acylamino, sulfonylamino, ureido, urethane, sulfamoyl, carbamoyl, alkylthio, arylthio, sulfonyl and sulfinyl groups, halogen atoms and cyano, aryloxycarbonyl, acyl, alkoxycarbonyl, acyloxy, carbonamido, sulfonamido and phosphonamido groups.

The groups represented by Y in formula (IV) are monovalent groups that can change to anionic functional groups through reaction with development processing solution components. Development processing solution components that can change Y are ordinary compounds that are contained in developers such as alkalis, hydroquinones and sulfite ions, etc., as well as surfactants, amines and organic acid salts, etc. Further, in order to bring about a change of Y, special reagents such as fluoride ions, hydrazines or hydroxylamines, etc. may be added to the developer, and the change may be brought about by the combined action of these components.

Preferably, the change of Y to an anionic functional group is not one simply involving proton migration, as is the case with dissociation of acids by alkalis, but is a change that is accompanied by the cleavage or the formation of one or several covalent bonds by the action of development processing solution components. Preferably, the anionic functional groups produced are in a state in which they are bonded to the portion represented by X in formula (IV).

In the compounds represented by formula (IV), preferably, as indicated by the formulas below, oxidation - hydrolysis results in the release of a development inhibitor (X-Y) from redox parent nuclei and the change of Y (represented as $Y \rightarrow Y_1^{\theta}$) is brought about essentially after this by development processing solution components. Further, the development inhibiting action of compounds represented by $X—Y_1^{\theta}$ is smaller than that of compounds represented by X-Y.

The groups represented by Y in formula (IV) are preferably represented by the following formulas (VII) to (XII):

Formula (VII)

$$—Y_2—R_5$$

In formula (VII), $Y_2$ represents $$—\overset{O}{\overset{\|}{C}}O—,\ —SO_2O—,\ —\underset{R_6}{\underset{|}{N}}—SO_2O—,\ \text{or}$$

$$—\underset{O}{\underset{\|}{P}}(OR_6)O—,$$

$R_5$ represents groups with the same definitions as given for $R_1$ of formula (I), and $R_6$ represents a hydrogen atom or groups with the same definitions as given for $R_5$.

Formula (VIII)

$$—Y_3—\underset{R_7}{\underset{|}{C}}=\overset{R_7}{\overset{|}{C}}$$

or a precursor thereof

In formula (VIII), $Y_3$ represents $$—SO_2—,\ —\underset{O}{\underset{\|}{C}}—\ \text{or}\ —(NH\underset{O}{\underset{\|}{C}})_m—,$$

and m is 1 or 2. $R_7$ represents groups with the same definitions as given for $R_5$ in formula (VII) or a hydrogen atom, and the three $R_7$ groups may be the same or different.

Formula (IX)

$$—SO_2—\underset{Y_5}{\underset{|}{C}}=\underset{Y_5}{\underset{|}{C}}—Y_4—Y_5$$

In formula (IX), $Y_4$ represents $$—\underset{O}{\underset{\|}{C}}—\ \text{or}\ —SO_2—,$$

and $Y_5$ represents a monovalent group. The three $Y_5$ groups may be the same or different and any two of them may be bonded together to form a ring such as cyclopentenone, cyclohexenone, uracil, cyclopentene and cyclohexene. The monovalent groups represented by $Y_5$ include a hydrogen atom, a halogen atom, a cyano group, a nitro group, an alkyl group, an aryl group, an acyl group, an alkylsulfonyl group, an arylsulfonyl group, an alkoxy group, an aryloxy group, a carbamoyl group, a sulfamoyl group, an alkylthio group, an arylthio group, a sulfinyl group, an alkyloxycarbonyl group, an aryloxycarbonyl group, a substituted amino group, a carbonamido group and a sulfonamide group, etc.

Formula (X)

$$-SO_2-CH_2CH_2-Y_4-Y_5$$

In formula (X), $Y_4$ and $Y_5$ have the same meaning as in formula (IX).

Formula (XI)

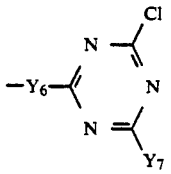

In formula (XI), $Y_6$ represents a single bond, —O— or —NH—, and $Y_7$ represents Cl, OH or $-NH_2$.

Formula (XII)

$$-Y_6-Y_4-CH_2Y_8$$

In formula (XII), $Y_4$ and $Y_6$ have the same meaning as in formula (IX) and formula (XI), respectively and $Y_8$ represents a halogen.

In addition to the above, one can also cite formyl groups, —N=C=O groups and

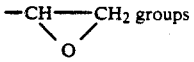

as preferred examples of Y.

$R_1$ and $-(Time)_r-$ in formula (I) and formula (IV) may incorporate ballast groups such as are normally employed as immobile photographic additives such as couplers, or groups that promote the adsorption of the compounds represented by formula (I) and formula (IV) on silver halide.

Ballast groups are organic groups which provide sufficient molecular weight substantially to prevent dispersion of the compounds represented by formula (I) and formula (IV) into other layers or into the processing solutions. These ballast groups are constituted by a combination of one or more groups such as alkyl, aryl, heterocyclic, ether, thioether, amido, ureido, urethane and sulfonamide groups, etc. The ballast groups are preferably ballast groups which possess substituted benzene rings, and ballast groups with benzene rings substituted by branched alkyl groups are particularly preferred.

Specifically, such groups for promoting adsorption on silver halide include 4-thiazoline-2-thione, 4-imidazoline-2-thione, 2-thiohydantoin, thiocyanate, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine, 1,3-imidazoline-2-thione and similar cyclic thioamide groups, chain thioamide groups, aliphatic mercapto groups, aromatic mercapto groups and heterocyclic mercapto groups (in the case where the neighbors of the carbon atoms to which -SH groups are bonded are nitrogen atoms, the meaning is the same as for tautomerically related cyclic thioamido groups and specific examples of these thioamido groups are the same as the examples listed above), groups having a disulfide bond, benzotriazole, triazole, tetrazole, indazole, benzimidazole, imidazole, benzothiazole, thiazole, thiazoline, benzoxazole, oxazole, oxazoline, thiadiazole, oxathiazole, triazine, azaindene and similar 5- to 6-member nitrogen-containing heterocyclic groups constituted by combinations of nitrogen, oxygen, sulfur and carbon atoms, and heterocyclic quaternary salts such as benzimidazolium, etc.

These may further be substituted by suitable substituents.

These substituents include the substituents noted for $R_1$.

Examples of compounds represented by formulae (I), (II) and (III) that are employed in the present invention are shown below, although the invention is not limited to these examples:

1

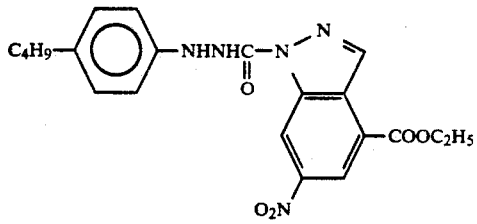

2

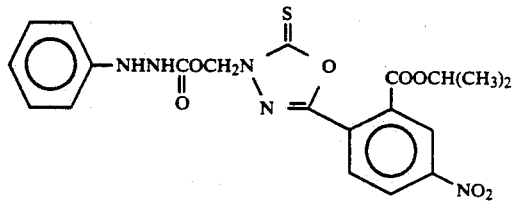

-continued
3
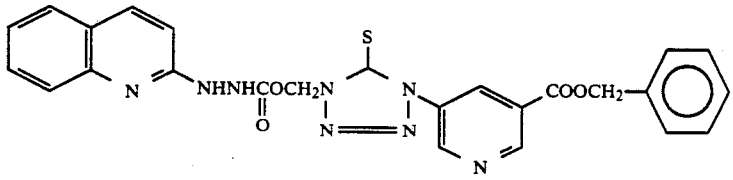
4
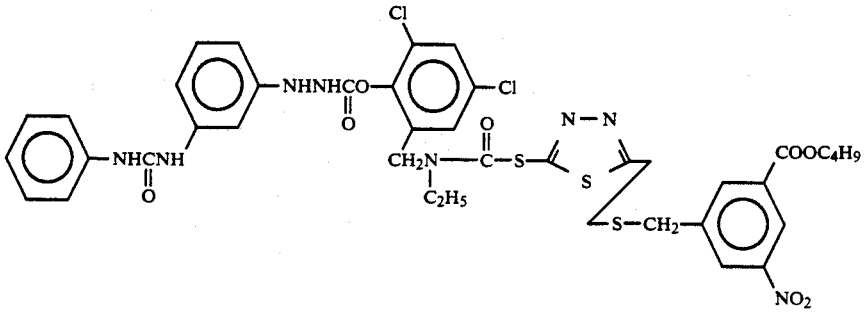
5
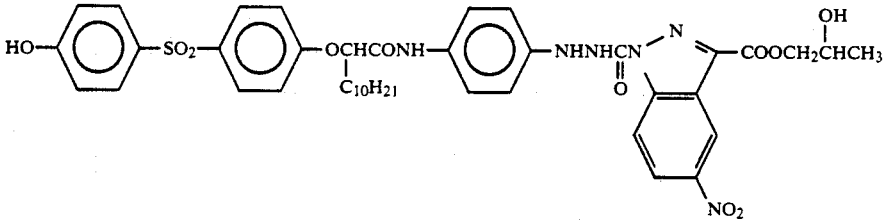
6
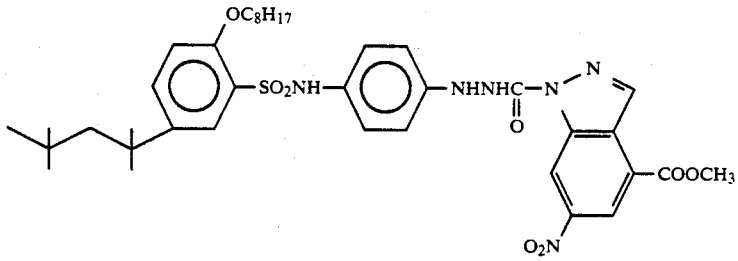
7
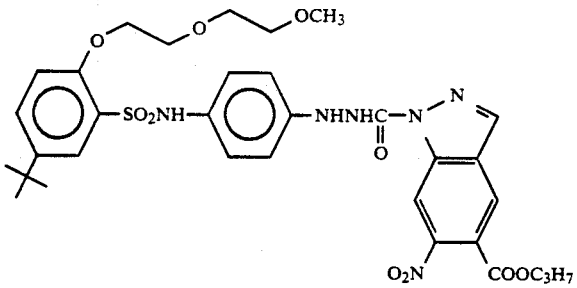
8
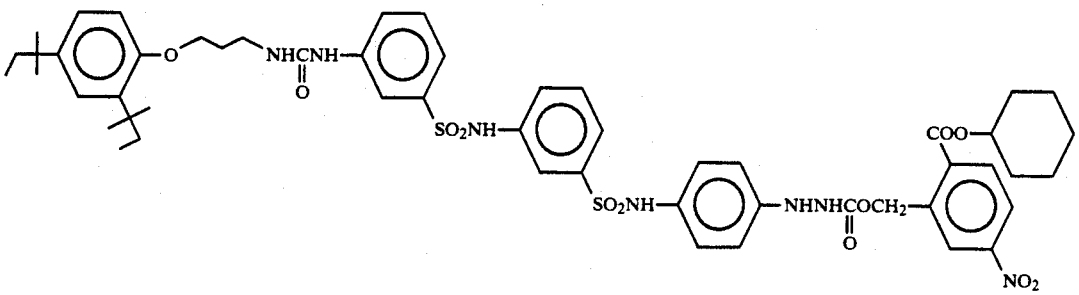

-continued
9
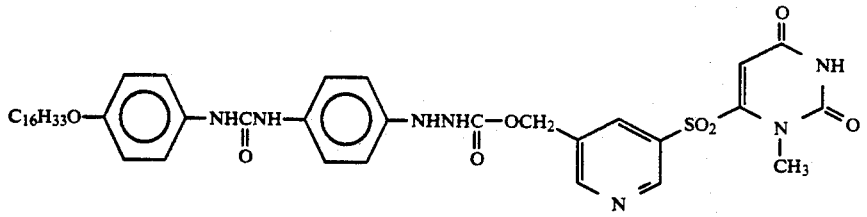
10
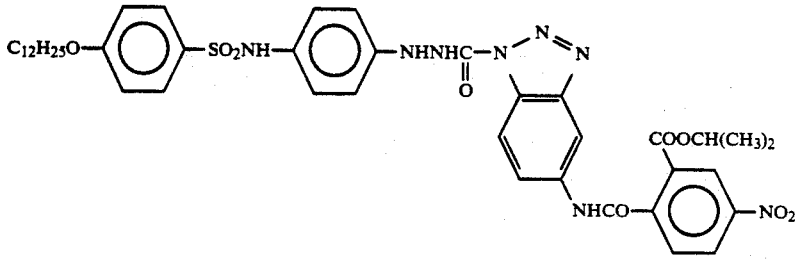
11
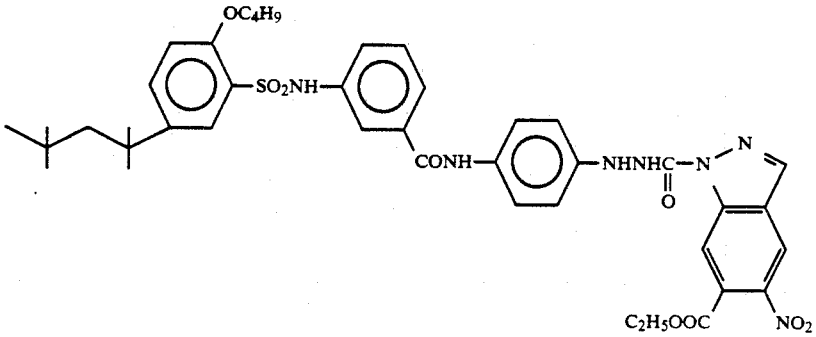
12
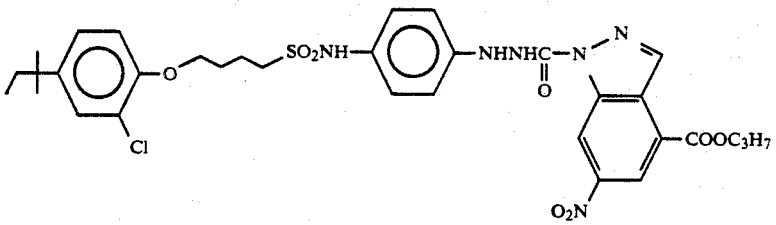
13
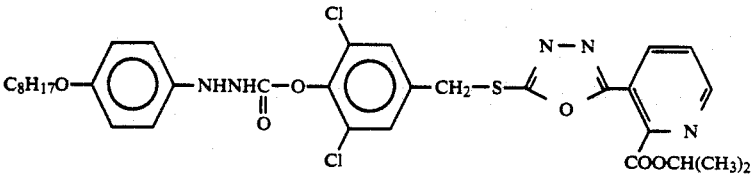
14
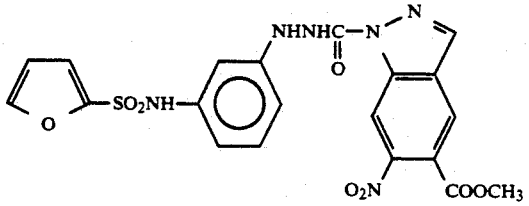

-continued
15
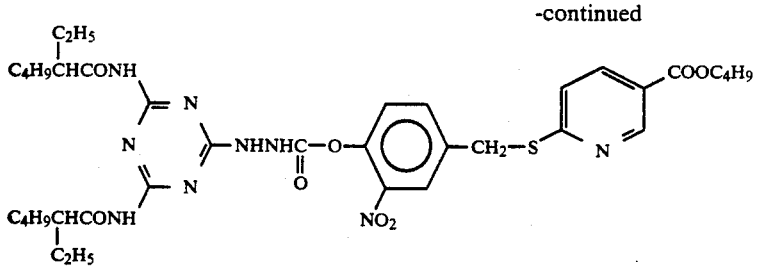
16
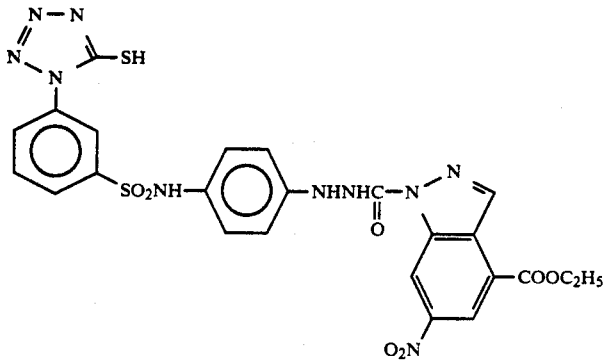
17
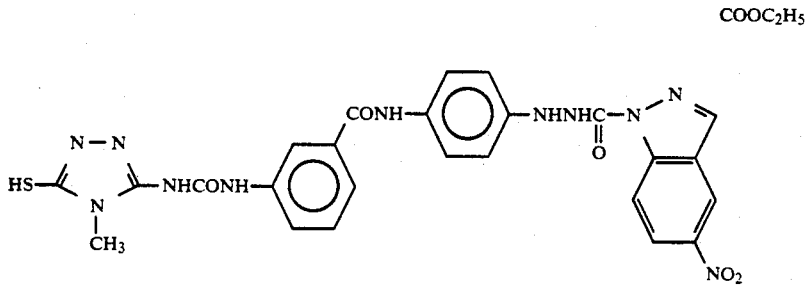
18
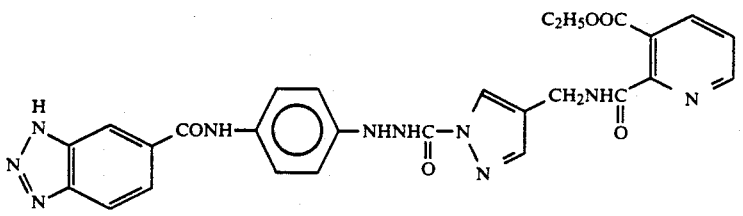
19
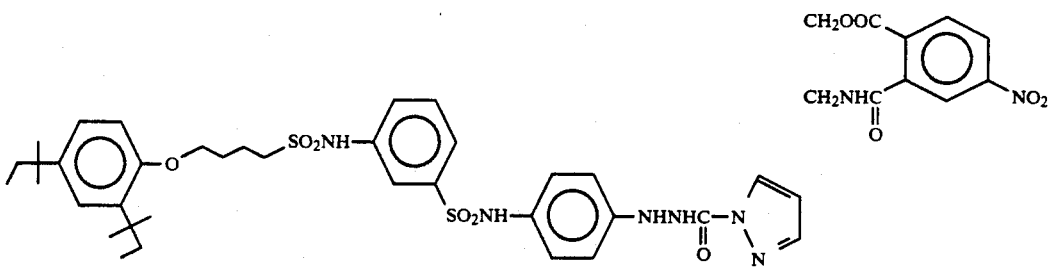
20
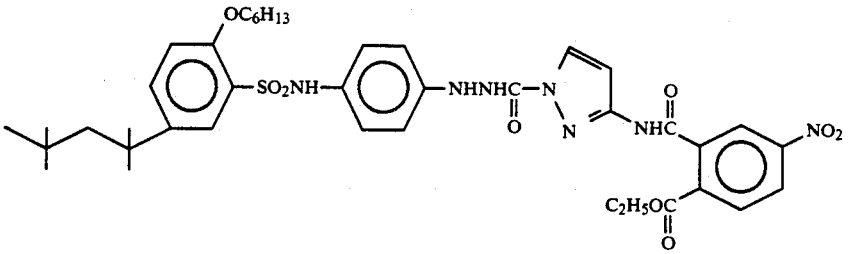

-continued
21
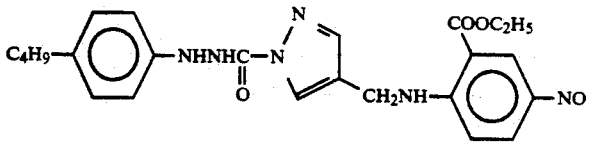
22
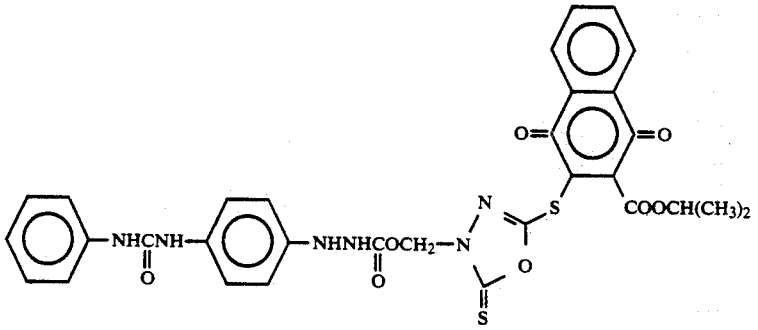
23
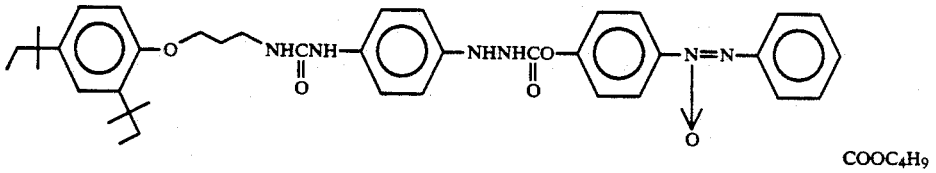
24
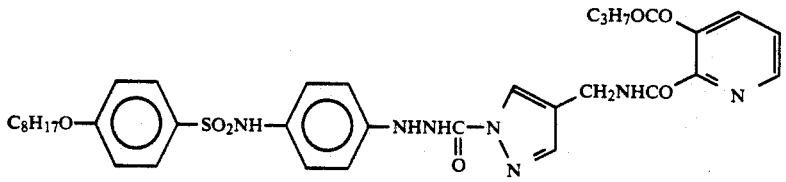
25
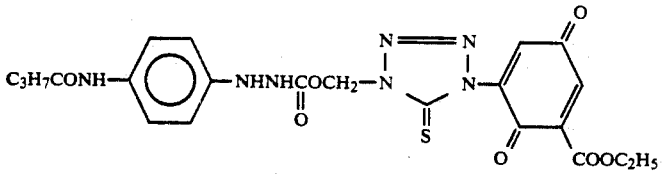
26
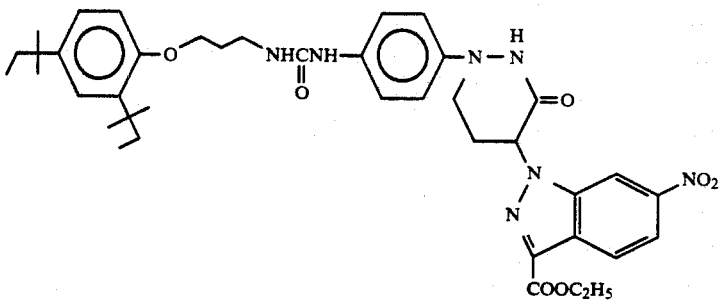
27
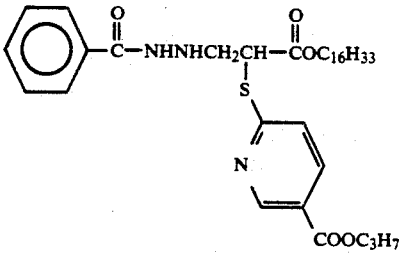

-continued

28

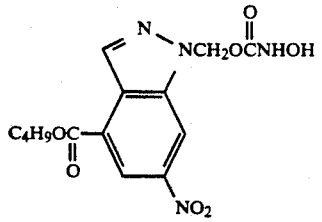

Usually, the formula (I) compounds of the invention are synthesized by the following methods. They are either synthesized through a reaction of a corresponding 2-equivalent PUG—(Time)$_t$—H with trichloromethyl chlorocarbonate in the presence of triethylamine or a similar base in an organic solvent such as THF to form a symmetric carbonyl compound, followed by a reaction with a corresponding hydrazine compound (Synthesis Method 1). Additionally, one may condense a corresponding PUG—(Time)$_t$—H with p-nitrophenyl chlorocarbonate in the presence of a base followed by a reaction with a corresponding hydrazine compound (Synthesis Method 2).

Synthesis Method 1:

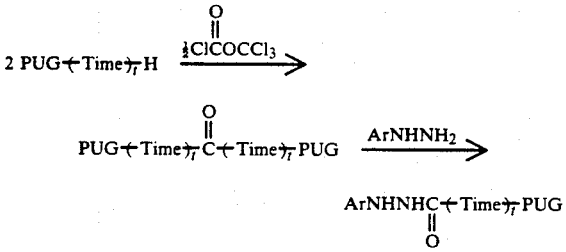

Synthesis Method 2:

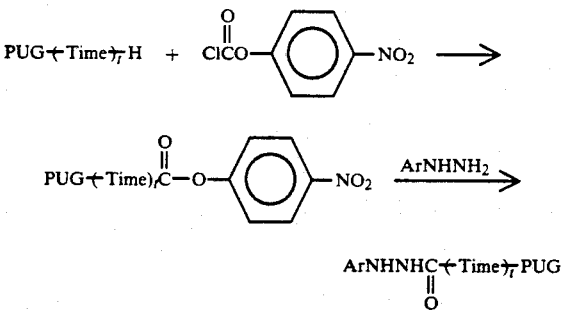

More specifically, they are synthesized by the methods described in JP-A-61-213847, JP-A-62-260153, U.S. Pat. No. 4,684,604 and Japanese Patent Application Nos. 1-290563, 2-62337 and 2-64717, or methods similar thereto.

Further, the compounds represented by formulae (II) and (III) are synthesized by the methods described in U.S. Pat. No. 4,684,604.

The redox compounds of the present invention are used in the range $1\times10^{-6}$ to $5\times10^{-2}$ moles, and preferably $1\times10^{-5}$ to $1\times10^{-2}$ moles, per 1 mole, of silver halide.

The redox compounds of the present invention can be used dissolved in a suitable water-miscible organic solvent such as an alcohol (methanol, ethanol, propanol, fluorinated alcohol), a ketone (acetone, methyl ethyl ketone), a dimethyl formamide, a dimethyl sulfoxide or a methyl cellosolve.

Alternatively, one can use them after employing a wellknown emulsification-dispersion procedure to dissolve them in dibutyl phthalate, tricresyl phosphate, glyceryl triacetate, diethyl phthalate or a similar oil, using a co-solvent such as ethyl acetate or cyclohexanone, etc., and mechanically producing an emulsified dispersion. Further, one can use them after employing a method that is known as a solids dispersion method to effect ball mill, colloid mill or ultrasonic dispersion of a redox compound powder in water.

The redox compounds of the present invention are added to a silver halide emulsion layer or another hydrophilic colloid layer. Also, they may be added to one or a plurality of silver halide emulsion layers. A number of examples of structure will be given, although the present invention is not limited to these examples.

EXAMPLE OF STRUCTURE (1)

A silver halide emulsion layer containing a redox compound of the present invention and a protective layer are provided on a support. A second hydrazine compound may be included as a nucleation agent in the emulsion layer or the protective layer.

EXAMPLE OF STRUCTURE (2)

A first silver halide emulsion layer and a second silver halide emulsion layer are successively provided on a support and a second hydrazine compound is included in the first silver halide emulsion layer or in an adjacent hydrophilic colloid layer, and a redox compound as noted above is included in the second silver halide emulsion layer or the adjacent hydrophilic colloid layer.

EXAMPLE OF STRUCTURE (3)

This is a structure in which the order to the two emulsion layers of Example of Structure (2) is reversed.

In Examples of Structure (2) and (3), an intermediate layer containing gelatin or a synthetic polymer (polyvinyl acetate, polyvinyl alcohol, etc.) may be provided between the two photosensitive emulsion layers.

EXAMPLE OF STRUCTURE (4)

A silver halide emulsion layer containing a second hydrazine compound is provided on a support, and a hydrophilic colloid layer containing a redox compound as noted above is provided on top of this silver halide emulsion layer or between it and the support.

Particularly preferred structures are the Examples of Structure (2) and (3).

The second hydrazine compound used in the present invention is a hydrazine derivative which has a so-called nucleating effect and it is, for example, preferably a compound as represented by the following formula (A)

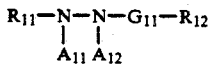

Formula (A)

In formula (A), $R_{11}$ represents an aliphatic group or an aromatic group, $R_{12}$ represents a hydrogen atom or an alkyl, aryl, alkoxy, aryloxy, amino or hydrazine group, and $G_{11}$ represents a

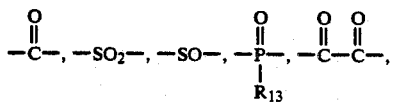

thiocarbonyl or iminomethylene group. $A_{11}$ and $A_{12}$ each represents a hydrogen atom or one of them represents a hydrogen atom and the other a substituted or unsubstituted alkylsulfonyl group, a substituted or unsubstituted arylsulfonyl group or a substituted or unsubstituted acyl group.

$R_{13}$ is selected from among the groups as defined for $R_{12}$ and it may be different from $R_{12}$.

An aliphatic group represented by $R_{11}$ in formula (A) is preferably a 1-30C group, and more particularly it is a 1-20C straight-chain, branched or cyclic alkyl group. This alkyl group may possess substituents.

An aromatic group represented by $R_{11}$ in formula (A) is a single-ring or double-ring aryl group or unsaturated heterocyclic group. The unsaturated heterocyclic group in this case may form a fused ring with an aryl group.

A preferred group for $R_{11}$ is an aryl group, and a group containing a benzene ring is particularly preferred.

The $R_{11}$ aliphatic group or aromatic group may be substituted, examples of which include alkyl, aralkyl, alkenyl alkynyl, alkoxy, aryl, substituted amino, ureido, urethane, aryloxy, sulfamoyl, carbamoyl, alkyl- or arylthio, alkyl- or arylsulfonyl, alkyl- or arylsulfinyl and hydroxy groups, halogen atoms and cyano, sulfo, aryloxycarbonyl, acyl, alkoxycarbonyl, acyloxy, carbonamido, sulfonamido, carboxyl, amidophosphate, diacylamino, imido and

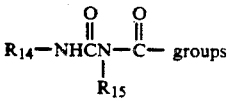

groups (wherein $R_{14}$ and $R_{15}$ are selected from among the same groups identified as $R_2$ and may be the same or different from one another). Preferred substituents include alkyl groups (preferably 1-20C groups), aralkyl groups (preferably 7-30C groups), alkoxy groups (preferably 1-20C groups), substituted amino groups (preferably amino groups in which there is substitution by 1-20C alkyl groups and acylamino groups (preferably 2-30C groups)), sulfonamido groups (preferably 1-30C groups), ureido groups (preferably 1-30C groups) and amidophosphate groups (preferably 1-30C groups). These groups may be further substituted.

Alkyl groups represented by $R_{12}$ in formula (A) are preferably 1-4C alkyl groups, and single-ring or double-ring aryl groups (for example, groups containing benzene rings) are preferred among the aryl groups.

If $G_{11}$ is a

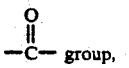

group, preferred groups for the group represented by $R_{12}$ include hydrogen atoms, alkyl groups (for example, methyl, trifluoromethyl, 3-hydroxypropyl, 3-methanesulfonamidopropyl, phenylsulfonylmethyl, etc.), aralkyl groups (for example, o-hydroxybenzyl, etc.) and aryl groups (for example, phenyl, 3,5-dichlorophenyl, o-methanesulfonamidophenyl, 4-methanesulfonamidophenyl, 2-hydroxymethylphenyl, etc.). Hydrogen atoms are particularly preferred.

$R_{12}$ may be substituted, and if so, the substituents cited in relation to $R_{11}$ may be employed.

A

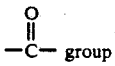

group is the most preferred example of G in formula (A).

$R_{12}$ may also be a group which splits a $G_{11}$—$R_{12}$ portion from the residual molecules and brings about a cyclization reaction which produces a cyclic structure containing the atoms of the —$G_{11}$—$R_{12}$ portion, examples of which groups include the groups noted in JP-A-63-29751.

Hydrogen atoms are the most preferred $A_{11}$ and $A_{12}$ groups.

$R_{11}$ and $R_{12}$ in formula (A) may incorporate ballast groups or polymers such as are normally employed as immobile photographic additives such as couplers. Ballast groups are groups possessing 8 or more carbon atoms which have comparatively no effect on photographic properties. They can be selected from among, for example, alkyl, alkoxy, phenyl, alkylphenyl, phenoxy and alkylphenoxy groups, etc. The substances noted in JP-A-1-100530 can be cited as polymers.

Groups for reinforcing adsorption on silver halide grain surfaces may be incorporated in the $R_{11}$ and $R_{12}$ groups of formula (A). These adsorption groups include the thiourea, heterocyclic thioamido, heterocyclic mercapto, triazole and other groups disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Examples of compounds represented by formula (A) will now be given . However, the invention is not limited to the compounds noted below.

A-1

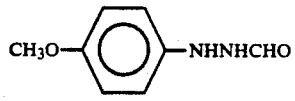

-continued
A-2
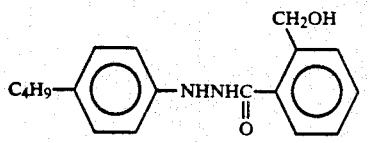
A-3
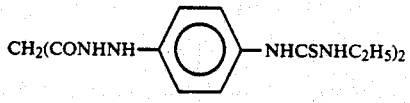
A-4
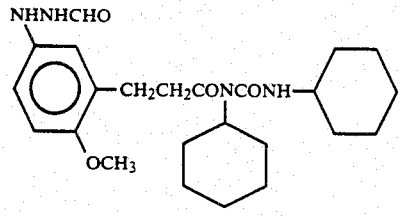
A-5
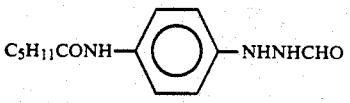
A-6
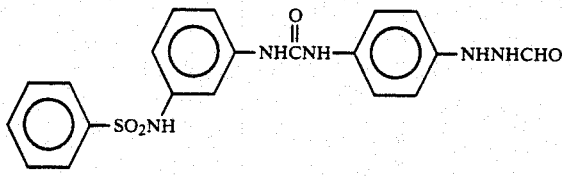
A-7
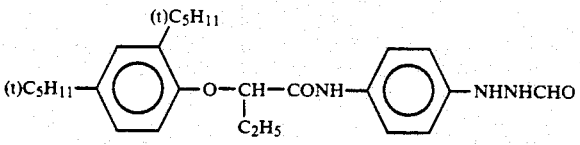
A-8
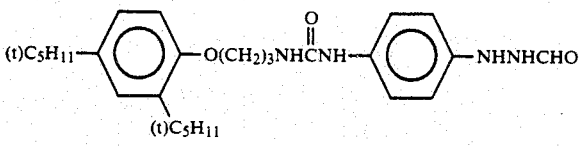
A-9
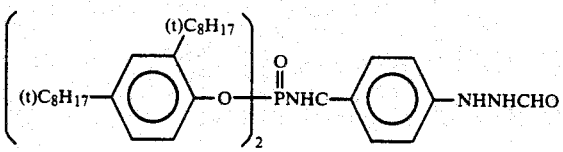
A-10
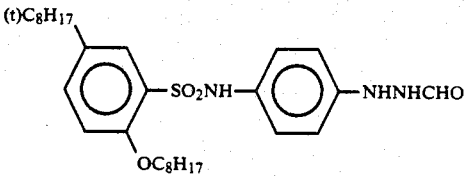
A-11
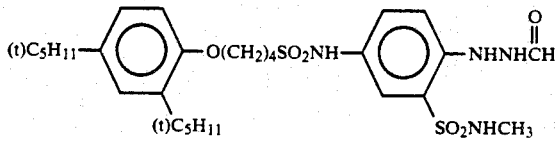

-continued
A-12
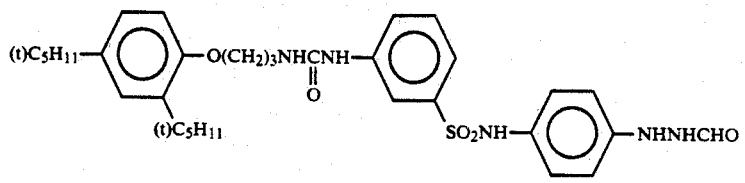
A-13
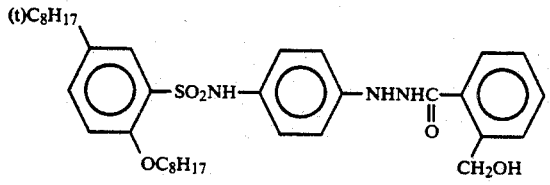
A-14
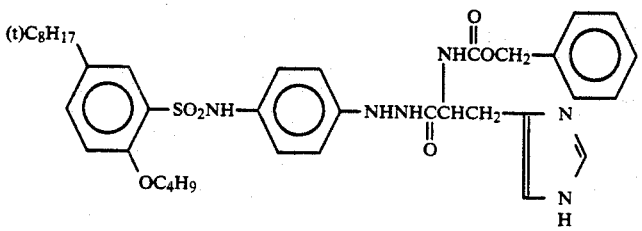
A-15
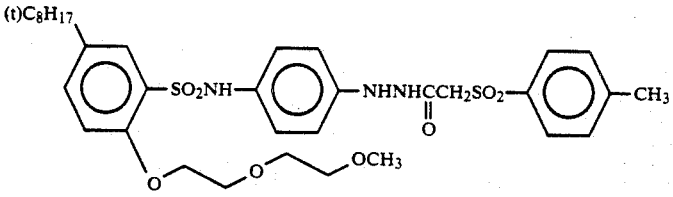
A-16
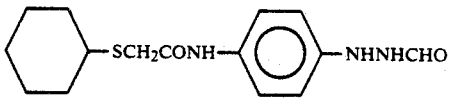
A-17
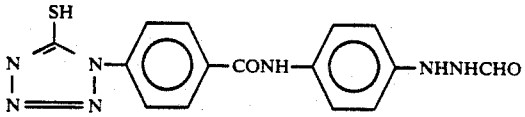
A-18
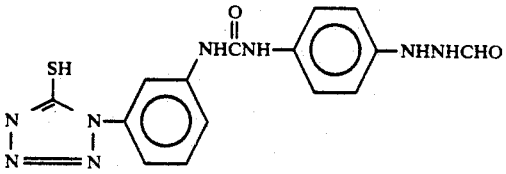
A-19
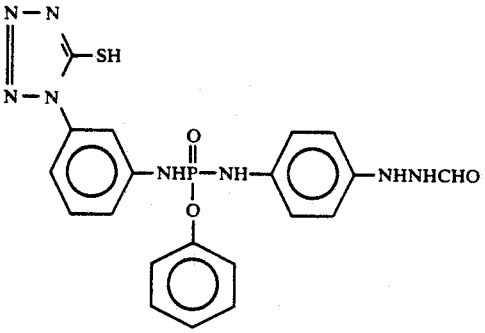

-continued
A-20
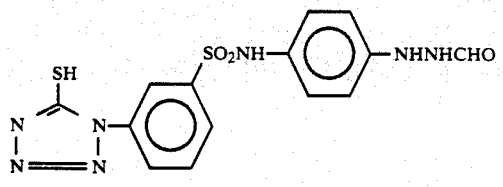
A-21
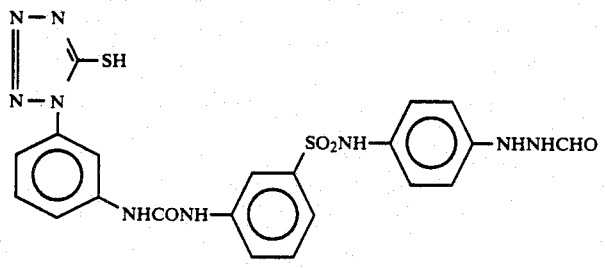
A-22
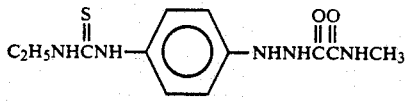
A-23
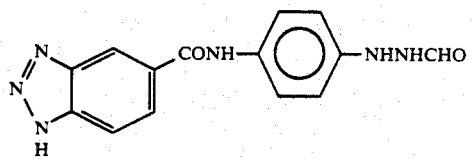
A-24
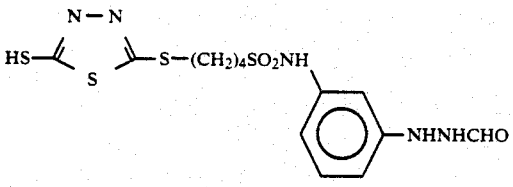
A-25
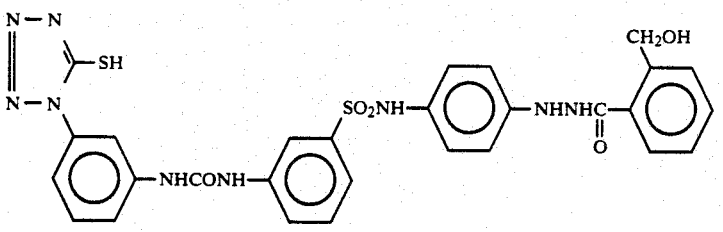
A-26
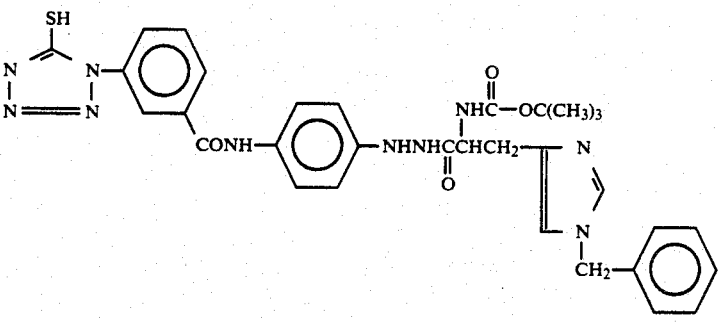

-continued

A-27

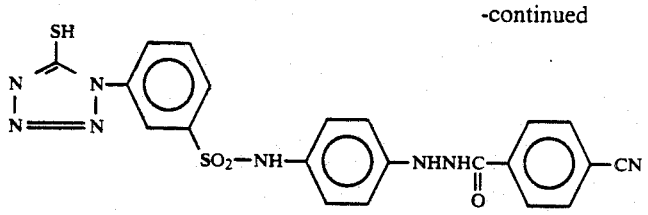

In addition to the compounds noted above, the second hydrazine compounds used in the present invention may also be the compounds noted in Research Disclosure Item 23516 (November 1983 number, page 346) and in the literature cited therein or the compounds noted in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-270948, EP 217310, EP 356898, U.S. Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-105941, JP-A-1-105943, JP-A-64-10233, JP-A-1-90439, JP-A-1-276128, JP-A-1-280747, JP-A-1-283548, JP-A-1-283549, JP-A-1-285940, JP-A-2-2541, JP-A-2-77057, JP-A-2-198440, JP-A-2-198441, JP-A-2-198442, JP-A-2-196234, JP-A-2-196235, JP-A-2-220042, JP-A-2-221953, JP-A-221954, JP-A-2-302750 and JP-A-2-304550.

The amount of the second hydrazine compound included relative to 1 mole of silver halide in the present invention is preferably $1\times10^{-6}$ moles to $5\times10^{-2}$ moles, and an addition in the range $1\times10^{-5}$ moles to $2\times10^{-2}$ moles is particularly preferred.

The second hydrazine derivatives of the present invention can be dissolved or dispersed by the same procedure as used for the redox compounds of formulae (I), (II) and (III).

The silver halide emulsion used in the present invention may have a composition such as silver chloride, silver bromide, silver chlorobromide, silver iodobromide, silver iodochlorobromide, etc.

With regard to the average grain size of silver halide used in the invention, fine grains (for example, 0.7 μm or less) are preferred and a size of 0.5 μm or less is particularly preferred. There are no basic restrictions on the grain size distribution, although a monodispersion is preferred. What is meant here by "monodispersion" is a material constituted by a group of grains such that, in terms of their weight or number, at least 95% of the grains possess a size that is within ±40% of the average grain size.

The silver halide grains in the photographic emulsion may be ones with a cubic, octahedral or similar regular crystal form or may be ones with spheroidal, plate-shaped or similar irregular crystals or they may have shapes combining these various crystal shapes.

The silver halide grains may have interiors and surface layers constituted by a uniform phase or by different phases. Also, two or more types of separately prepared silver halide emulsions may be used in the invention.

Cadmium salts, sulfurous acid salts, lead salts, thallium salts, rhodium salts or complexes or iridium salts or complexes, etc., may be present together in the process of formation or physical ripening of silver halide grains in the silver halide emulsions used in the present invention.

Filter dyes or water-soluble dyes for the prevention of irradiation or various other purposes may be included in emulsion layers or other hydrophilic colloid layers in the present invention. By way of filter dyes, one can use dyes for further lowering the photographic speed, preferably ultraviolet ray absorbers which display maximum spectral absorption in the inherent sensitivity region of a silver halide, or dyes which essentially absorb light mainly in the 350–600 nm region and are for the purpose of increasing safety in safe lights when the material is used as a daylight light-sensitive material.

Depending on the intended use, these dyes may be added to emulsion layers or be added together with a mordant to the top portion of silver halide emulsion layers, which is to say to a light-insensitive hydrophilic colloid layer that is farther from the support than the silver halide emulsion layers.

Although it varies depending on the molecular absorption coefficient of the dye, the amount added is normally in the range $10^{-2}-1$ g/m$^2$. Preferably the amount is 50–500 mg/m$^2$.

Examples of dyes are described in detail in JP-A-63-64039 and a few examples will now be given:

1.

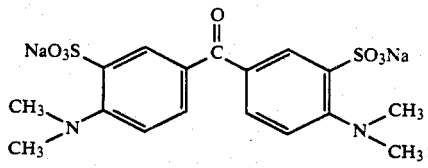

2.

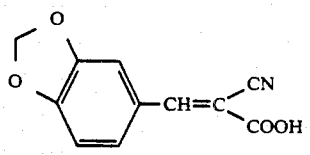

3.

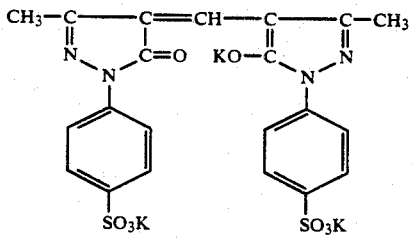

4.

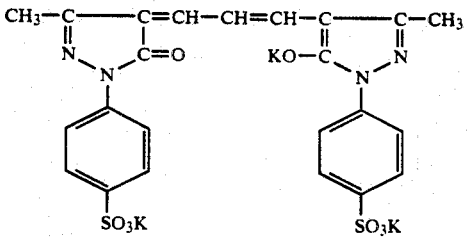

-continued

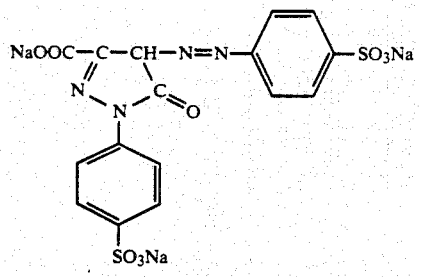

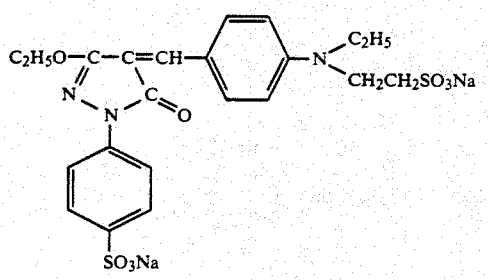

The above dyes are dissolved in a suitable solvent [for example, water, an alcohol (such as, methanol, ethanol, propanol, etc.), acetone or methylcellosolve, etc., or a solvent mixture of such substances] and added to a coating solution for a light-insensitive hydrophilic colloid layer of the present invention.

These dyes may be used in a combination of two or more dyes.

The dyes in the present invention are used in the amounts necessary to permit daylight handling.

The specific amount of dye used is usually $10^{-3}$ to 1 g/m$^2$, and more particularly a suitable amount can be selected in the range $10^{-3}$ to 0.5 g/m$^2$.

It is advantageous to use gelatin as a photographic emulsion binder or as a protective colloid, although it is also possible to use protective colloids other than gelatin. For example, gelatin derivatives, graft polymers of gelatin and other high polymers, albumin, casein and similar proteins, hydroxyethylcellulose, carboxymethylcellulose, cellulose sulfate esters and similar cellulose derivatives, sodium alginate, starch derivatives and similar sugar derivatives, polyvinyl alcohol, polyvinyl alcohol partial acetals, poly-N-vinylpyrrolidone, polyacrylic aid, polymethacrylic acid, polyacrylamides, polyvinyl imidazole or polyvinyl pyrazole, etc. may be used alone or in the form of copolymers or many other types of synthetic hydrophilic polymer substances.

The gelatin used may be lime-treated gelatin or it may be acid-treated gelatin, and it is also possible to use gelatin hydrolysis products or gelatin enzyme decomposition products.

Silver halide emulsions used in the method of the present invention may be emulsions that have been chemically sensitized or emulsions that have not been chemically sensitized. Sulfur sensitization, reduction sensitization and noble metal sensitization are known as methods for chemical sensitization of silver halide emulsions, and sensitization may be effected using any of these methods alone or in combination.

A representative noble metal sensitization procedure is gold sensitization and the main gold compounds used in this procedure are complex salts of gold. There is no objection to inclusion of complex salts of noble metals other than gold, such as platinum, palladium or iridium, etc. Specific examples are given in U.S. Pat. No. 2,448,060 and British Patent 618,061, etc.

Among sulfur sensitizers one can use are sulfur compounds contained in gelatin or a variety of sulfur compounds such as thiosulfates, thoiureas, thiazoles and thiocyanates, etc.

Stannous salts, amines, formamidinesulfinic acid and silane compounds, etc. can be used as reduction sensitizers.

Known spectral sensitizing dyes may be added to the silver halide emulsion layers that are used in the present invention.

A variety of compounds may be included in the photographic material of the present invention for the purpose of preventing fogging during the manufacture, storage or photographic processing of the material or stabilizing photographic performance. In more detail, one can add many compounds that are known as antifoggants or stabilizers, for example, azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds such as oxazolinethione; azaindenes such as triazaindenes, tetra-azaindenes (especially 4-hydroxy substituted (1,3,3a,7)tetra-azaindene), pentaazaindenes, etc.; benzenethiosulfonic acid, benzenesulfinic acid and benzenesulfonamide, etc. Preferred among such compounds are benzotriazoles (for example, 5-methylbenzotriazole) and nitroindazoles (for example, 5-nitroindazole). These compounds may also be included in processing solutions.

The photographic material of the present invention may have an inorganic or organic hardener included in photographic emulsion layers or other hydrophilic colloid layers. For example, chromium salts (for example, chrome alum), aldehydes (glutaraldehyde, etc.), N-methylol compounds (dimethylolurea, etc.) dioxane derivatives, active vinyl compounds (1,3,5-triacryloylhexahydro-s-triazine,1,3-vinylsulfonyl-2-propanol, etc.), active halogen compounds (2,4-dichloro-6-hydroxy-s-triazine, etc.) and mucohalogenic acids and the like can be used alone or in combination.

Coating assistants or different types of surfactants for various objects such as the prevention of static electricity charges, improvement of sliding properties, emulsification and dispersion, prevention of adhesion and improvement of photographic characteristics (for example, acceleration of development, improvement of contrast, sensitization) may be included in photographic emulsion layers or other hydrophilic colloid layers of light-sensitive material produced using the present invention.

For example, saponins (steroid-based), alkylene oxide derivatives (for example, polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines or amides, silicone polyethylene oxide adducts), glycidol derivatives (for example, alkenylsuccinate polyglyceride and alkylphenol polyglyceride), polyhydric alcohol fatty acid esters, sugar alkyl esters and similar nonionic surfactants; alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters and similar anionic surfactants containing acidic groups such as carboxy, sulfo, phospho, sulfuric acid ester and phosphoric acid ester groups, etc.; amino acids, aminoalkylsulfonic acids, aminoalkylsulfuric acid or -phophoric acid esters, alkylbetaines, amine oxides and similar amphoteric surfactants; and alkylamine salts, aliphatic or aromatic quaternary ammonium salts, pyridinium, imidazolium and similar heterocyclic quaternary ammonium salts, phosphonium or sulfonium salts containing aliphatic or heterocyclic rings and similar cationic surfactants can be used.

Surfactants that are particularly preferred for use in the present invention are the polyalkylene oxides with a molecular weight of 600 or more that are disclosed in JP-B-58-9412. (The term "JP-B" as used herein means an "examined Japanese patent publication".) Also, a polymer latex such as polyalkyl acrylate may be included in order to stabilize dimensions.

The compounds disclosed in JP-A-53-77616, JP-A-54-37732, JP-A-53-137133, JP-A-60-140340 and JP-A-60-14959, etc. and also various types of compounds containing N or S atoms are effective as development accelerators or agents for accelerating nucleating infectious development that are suitable for use in the present invention.

Specific examples will now be given.

1.

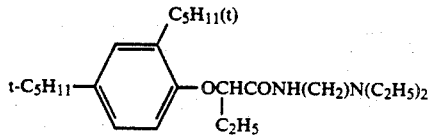

2.

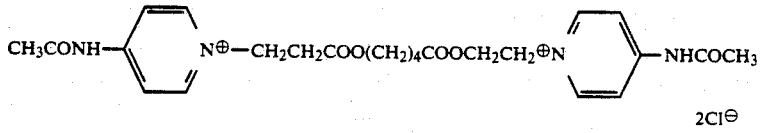

3.

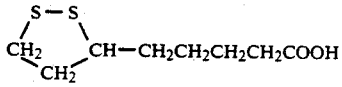

4.

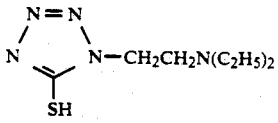

5.

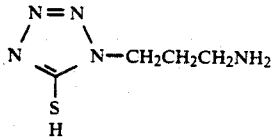

6.

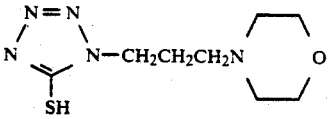

7.

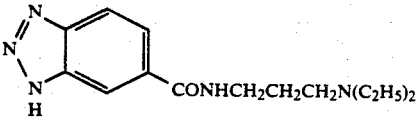

8.

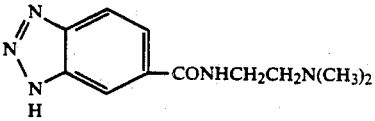

9.

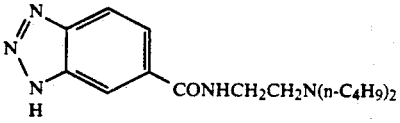

-continued

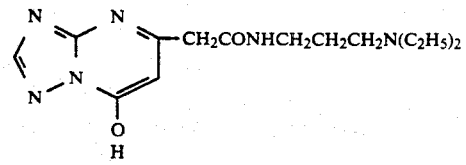

10.

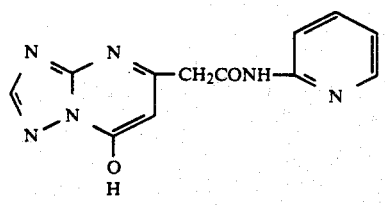

11.

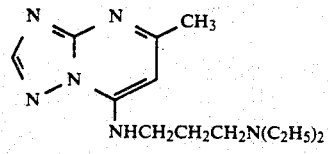

12.

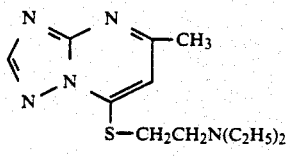

13.

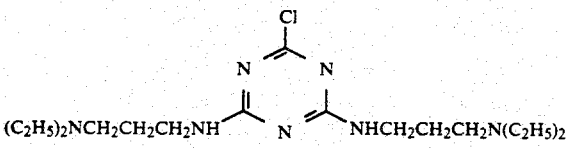

14.

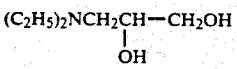

15.

16.

Although the optimum addition varies depending on the type of compound, it is preferable to use these accelerators in the range $1.0\times10^{-3}$ to 0.5 g/m$^2$, or more preferably $5.0\times10^{-3}$ to 0.1 g/m$^2$. These accelerators are dissolved in a suitable solvent ($H_2O$, an alcohol such as methanol or ethanol, acetone, dimethylformamide or methylcellosolve, etc.) and added to a coating solution.

One may make joint use of a plurality of these types of additives.

In order to achieve superhigh contrast photographic characteristics using the silver halide photographic material of the present invention, there is no need to use a conventional infectious development solution or the highly alkaline developer with a pH close to 13 that is disclosed in U.S. Pat. No. 2,419,975, but one can use a stable developer.

That is, with the silver halide photographic material of the present invention, superhigh contrast negative images can be produced satisfactorily by a developer which contains 0.10 mol/l or more of sulfite ions as a preservative and has a pH of 9.0–12.3, or more particularly a pH of 10.5–12.0.

There is no particular restriction regarding the developing agent used in the method of the invention but a variety of compounds such as those described in *The Theory of the Photographic Process*, 4th edition, by T. H. James, published by Macmillan, pages 298–327, can be used.

For example, dihydroxybenzenes (for example, hydroquinone), 3-pyrazolidones (for example, 1-phenyl-3-pyrazolidone, 4,4-dimethyl-1-phenyl-3-pyrazolidone), aminophenols (for example, N-methyl-p-aminophenol), ascorbic acid or hydroxylamines, etc. can be used alone or in combination.

The silver halide photographic material of the present invention is particularly suitable for processing with developers containing dihydroxybenzenes as the main developing agent and 3-pyrazolidones or aminophenols as an auxiliary developing agent. Preferably, dihydroxybenzenes in the range 0.05–0.5 mol/l are used together with 3-pyrazolidones or aminophenols in the range 0.06 mol/l or less in the developer.

Further, as described in U.S. Pat. No. 4,269,929, the speed of development can be increased and the development time shortened by adding amines to the developer.

The developer may also contain pH buffers such as alkali metal sulfites, carbonates, borates or phosphates, bromides, iodides, organic antifoggants (nitroindazoles and benzotriazoles being particularly preferred) or similar development inhibitors and antifoggants, etc. If required, it may further contain hard water softeners, auxiliary solvents, toning agents, development accelerators, surfactants (the polyalkylene oxides noted earlier being particularly preferred), antifoaming agents, film hardeners and agents for preventing silver staining in the film (for example, 2-mercaptobenzimidazolesulfonates, etc.).

A commonly-employed composition can be used as a fixer. In addition to using thiosulfates and thiocyanates for the fixer, one can also use organic sulfur compounds which are known to have effects as fixers. Water-soluble aluminum salts, etc. can be included in the fixer as film hardeners.

The processing temperature in the method of the present invention is normally selected within the range 18°-50° C.

Preferably, an automatic development unit is used for photographic processing. The method of the invention makes it possible for photographic characteristics with superhigh contrast negative gradation to be satisfactorily achieved even if the total processing time from introduction and exit of light-sensitive material into and from the automatic development unit is made only 90-120 seconds.

The compounds disclosed in JP-A-56-24347 can be used as silver staining preventors in the developer of the invention. The compounds described in JP-A-61-267759 can be used as auxiliary solvents that are added to the developer. Further, the compounds disclosed in JP-A-60-93433 or the compounds disclosed in JP-A-62-186259 can be employed as pH buffers employed in the developer.

The invention will now be described in detail by means of the following examples.

EXAMPLE 1

First light-sensitive emulsion layer

A double jet method was used over 12 minutes at 38° C. to add, with stirring, a 0.13M silver nitrate aqueous solution and a 0.04M potassium bromide and 0.09M sodium chloride halogen salt aqueous solution containing the equivalent of $1\times10^{-7}$ moles of $(NH_4)_3RhCl_6$ and $2\times10^{-7}$ moles of $K_3IrCl_6$ to an aqueous solution of gelatin containing 1,3-dimethyl-2-imidazolidinethione, thereby producing silver chlorobromide grains with an average grain size of 0.15 μm and a silver chloride content of 70 mol % and effecting nucleus formation.

Next, a double jet method was similarly used to combine a 0.87M silver nitrate aqueous solution and an aqueous halogen salt solution with a 0.26M potassium bromide and 0.65M sodium chloride content over a period of 20 minutes. This was followed by conversion by addition of $1\times10^{-3}$ moles of a KI solution, flocculation by normal procedure, addition of 40 g of gelatin, adjustment to a pH of 6.5 and a pAg of 7.5, chemical sensitization by addition of 5 mg of sodium thiosulfate and 8 mg of chloroauric acid per 1 mole of silver, and 60 minutes of heating at 60° C., and addition of 150 mg of 6-methyl-4-hydroxy-1,3,3a,7-tetraazaindene as a stabilizer. The average grain size of the resulting grains was 0.28 μm and the grains were cubic silver chlorobromide grains with a silver chloride content of 70 mol % (variation coefficient 10%).

The emulsion was divided up and this was followed by the addition, per 1 mole of silver, of $1\times10^{-3}$ moles of 5-[3-(4-sulfobutyl)-5-chloro-2-oxazolidene]-1-hydroxyethyl-3-(2-pyridyl)-2-thiohydantoin as a sensitizing dye and of $2\times10^{-4}$ moles of 1-phenyl-5-mercaptotetrazole, $5\times10^{-4}$ moles of a short-wave cyanine dye represented by the structural formula (a) below, the polymer (200 mg/m²) represented by (b), a polyethyl acrylate dispersion (200 mg/g²) and 1,3-divinylsulfonyl-2-propanol (200 mg/m²). Finally, the hydrazine compound (c) indicated below was added.

Compound (a)

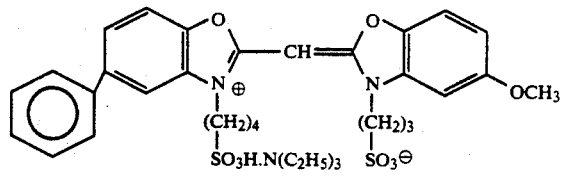

Compound (b)

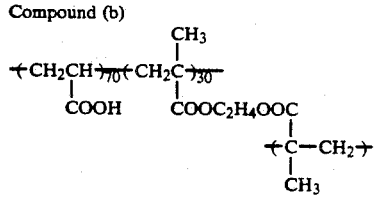

Hydrazine compound (c)

$2.8\times10^{-5}$ mol/m²

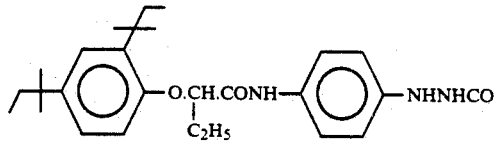

Intermediate layer coating

| | |
|---|---|
| Gelatin | 1.0 g/m² |
| Hardener (1,3-divinylsulfonyl-2-propanol) | 4.0 wt % relative to gelatin |

Second light-sensitive emulsion layer

(Preparation of light-sensitive emulsion B)

A monodispersed emulsion of cubic grains with an average grain size of 0.28 μm and an average silver iodide content of 0.3 mol % was prepared by taking a period of 60 minutes to simultaneously add a silver nitrate aqueous solution and a potassium iodide and potassium bromide aqueous solution to a gelatin aqueous solution held at 50° C. in the presence of ammonia and $4\times10^{-7}$ moles of potassium hexachloroiridate (III) per 1 mole of silver and keeping the pAg at 7.8 during this period. After desalting this emulsion by flocculation, 40 g of inert gelatin per 1 mole of silver was added and then the emulsion was held at 50° C. and added to a sensitization dye in the form of 5,5'-dichloro-9-ethyl-3,3'-bis(3-sulfopropyl)oxacarbocyanine and a solution of $10^{-3}$ moles of KI per 1 mole of silver. After the elapse of 15 minutes, the temperature was lowered.

Coating of the second light-sensitive emulsion layer

The light-sensitive emulsion B was redissolved, the reagents noted below were added at 40° C. and the emulsion was coated to an amount to give a coated silver quantity of 0.4 g/m² and 0.5 g/m² of gelatin.

| | |
|---|---|
| 5-Methylbenzotriazole | $5.0\times10^{-3}$ mol/Ag-mol |
| 6-Methyl-4-hydroxy-1,3,3a,7-tetraazaindene | $2\times10^{-3}$ mol/Ag-mol |
| Polyethyl acrylate | 30 wt % relative to gelatin |
| Hardener (C) | 4.0 wt % relative to gelatin |
| A redox compound of the | $2.0\times10^{-5}$ mol/m² |

-continued invention or comparative example as noted in Table 1

Coating of protective layer

Using the surfactants noted below, 1.5 g/m$^2$ of gelatin and 0.3 g/m$^2$ of polymethyl methacrylate particles (average particle diameter 2.5 μm) were coated on top to constitute a protective layer.

| Surfactants | |
|---|---|
| 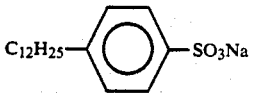 | 37 mg/m$^2$ |
| $CH_2COOC_6H_{13}$<br>\|<br>$CHCOOC_6H_{13}$<br>\|<br>$SO_3Na$ | 37 mg/m$^2$ |
| $C_8F_{17}SO_2NCH_2COOK$<br>\|<br>$C_3H_7$ | 2.5 mg/m$^2$ |

3200° K. tungsten light was used to expose the various samples via an optical wedge and a contact screen (Fuji Photo Film Co., Ltd. 150 L Chain-Dot model). The samples were developed for 30 seconds at 34° C. using the developer A noted below and were fixed, washed with water and dried.

The following formula was used to represent halftone gradation.

*Halftone gradation = The exposure (log $E$ 95%) giving a dot area ratio of 95% − The exposure (log $E$ 5%) giving a dot area ratio of 5%

The dot quality was evaluated macroscopically in 5 stages. In this 5-stage evaluation, "5" indicates the best quality and "1" the worst. For dot negatives for plate-making, "5" and "4" represent quality that is acceptable for practical purposes, "3" is the level of quality that is at the limit for practical purposes and "2" and "1" represent quality such that the negatives are unusable.

| Developer A | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetic acid | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| N-n-Butyldiethanolamine | 15.0 g |
| Sodium toluenesulfonate | 8.0 g |
| Water added to make | 1 liter |
| Adjustment to pH = 11.6 (potassium hydroxide added) | |

TABLE 1

| | Sample No. | Redox Compound | Halftone Gradation (Δlog E) | Dot Quality |
|---|---|---|---|---|
| 1 | Comparative Sample 1-a | — | 1.23 | 3 |
| 2 | Comparative Sample 1-b | Comparative Compound A | 1.30 | 4 |
| 3 | Comparative Sample 1-c | Comparative Compound B | 1.21 | 3 |
| 4 | Comparative Sample 1-d | Comparative Compound C | 1.27 | 3 |
| 5 | Comparative Sample 1-e | Comparative Compound D | 1.25 | 3 |
| 6 | Comparative Sample 1-f | Comparative Compound E | 1.45 | 5 |
| 7 | Invention 1-1 | Compound (1) | 1.43 | 5 |
| 8 | Invention 1-2 | Compound (5) | 1.40 | 5 |
| 9 | Invention 1-3 | Compound (6) | 1.49 | 5 |
| 10 | Invention 1-4 | Compound (7) | 1.48 | 5 |
| 11 | Invention 1-5 | Compound (11) | 1.45 | 5 |
| 12 | Invention 1-6 | Compound (12) | 1.48 | 5 |
| 13 | Invention 1-7 | Compound (13) | 1.40 | 5 |
| 14 | Invention 1-8 | Compound (18) | 1.43 | 5 |
| 15 | Invention 1-9 | Compound (19) | 1.45 | 5 |
| 16 | Invention 1-10 | Compound (20) | 1.43 | 5 |

Comparative Compound A
(Compound 28 disclosed in JP-A-61-213847)

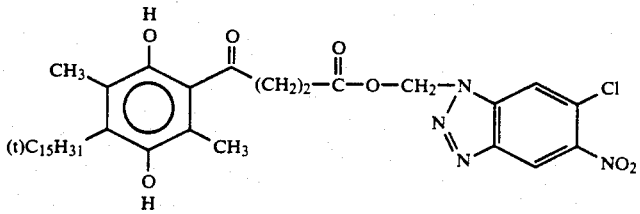

Comparative Compound B
(Compound 2 disclosed in JP-A-62-260153)

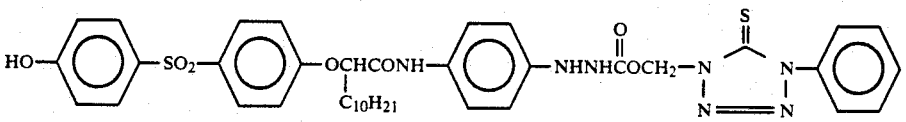

Comparative Compound C
(Compound 10 disclosed in JP-A-64-88451)

-continued

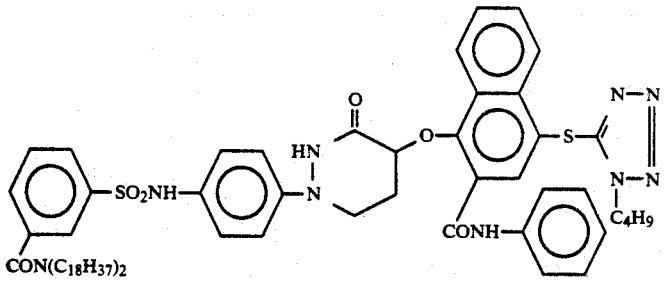

Comparative Compound D
(Compound 13 disclosed in JP-A-64-72140)

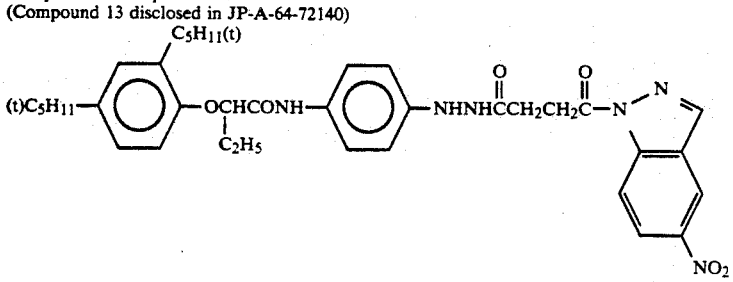

Comparative Compound E
(Compound described in Japanese Patent Application No. 2-62337)

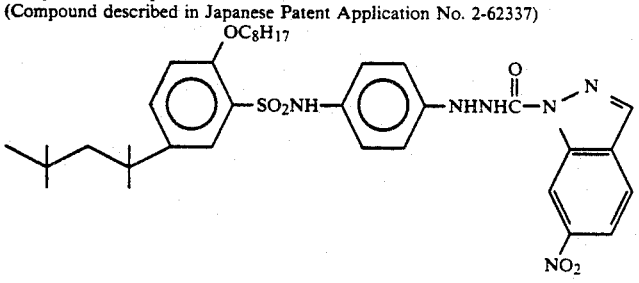

As seen from the results of Table 1, Comparative Sample 1-f and all the samples of the invention display broad halftone gradation and high dot quality.

EXAMPLE 2

The 16 different samples of Example 1 were used in development processing of a large number of sheets in the manner described below so as to give 16 types of exhausted developers B1–B16.

Processing conditions: 50.8 cm × 61 cm samples of light-sensitive material samples were exposed to give a blackening ratio of 80% and 200 sheets per day were processed for 30 seconds each using 20 liter of developer A held at 34° C.

Developer A and the 16 different exhausted developers were used and the various light-sensitive material samples that were used to produce the respective exhausted developers were exposed and subjected to development processing in the same way as in Example 1. Table 2 notes the differences in the resulting photographic speeds ($\Delta \log E_1$) in processing with developer A and with the exhausted developers B1–B16. The photographic sensitivity (log E) is the logarithmic value of the exposure needed to give a density of 1.5.

Next, GRANDEX Film GA100 (manufactured by Fuji Photo Film Co., Ltd.) was exposed and subjected to development processing in the same way as in Example 1, similarly using developer A and the exhausted developers B1–B16. Table 2 notes the differences in the resulting photographic sensitivity ($\Delta \log E_2$) in processing with developer A and with the exhausted developers B1–B16. It is seen from the results of Table 2 that variation of the photographic sensitivity of the samples of the present invention is little as compared with that of Comparative Examples 2-b to 2f and is at the same level as that of Comparative Example 2-a to which no redox compound was added.

TABLE 2

| | | Exhausted Developer | Change in photographic sensitivity with exhausted developers were used *1 | *2 |
|---|---|---|---|---|
| 1 | Comparative Example 2-a | B 1 | −0.05 | −0.08 |
| 2 | Comparative Example 2-b | B 2 | −0.29 | −0.33 |
| 3 | Comparative Example 2-c | B 3 | −0.25 | −0.27 |
| 4 | Comparative Example 2-d | B 4 | −0.24 | −0.25 |
| 5 | Comparative Example 2-e | B 5 | −0.36 | −0.39 |
| 6 | Comparative Example 2-f | B 6 | −0.35 | −0.35 |
| 7 | The Invention 2-1 | B 7 | −0.08 | −0.12 |
| 8 | The Invention 2-2 | B 8 | −0.09 | −0.13 |
| 9 | The Invention 2-3 | B 9 | −0.06 | −0.10 |
| 10 | The Invention 2-4 | B 10 | −0.08 | −0.12 |
| 11 | The Invention 2-5 | B 11 | −0.07 | −0.11 |
| 12 | The Invention 2-6 | B 12 | −0.06 | −0.10 |
| 13 | The Invention 2-7 | B 13 | −0.10 | −0.15 |
| 14 | The Invention 2-8 | B 14 | −0.10 | −0.14 |
| 15 | The Invention 2-9 | B 15 | −0.10 | −0.15 |

TABLE 2-continued

| | | Exhausted Developer | Change in photographic sensitivity with exhausted developers were used *1 | *2 |
|---|---|---|---|---|
| 16 | The Invention 2-10 | B 16 | −0.11 | −0.16 |

*1: Using light-sensitive materials that were employed to produce the exhausted developers ($\Delta \log E_1$)
*2: Using GRANDEX Film GA-100 ($\Delta \log E_2$)

EXAMPLE 3

Preparation of light-sensitive emulsion C

A silver nitrate aqueous solution and a sodium chloride aqueous solution were simultaneously mixed in a gelatin aqueous solution held at 50° C. in the presence of $5.0\times10^{-6}$ moles of $(NH_4)_3RhCl_6$ per 1 mole of silver. The soluble salts were removed by a procedure that is well-known in the field and then gelatin was added. Without chemical ripening being effected, 6-methyl-4-hydroxy-1,3,3a,7-tetraazaindene was added as a stabilizer. The resulting emulsion was a monodispersed emulsion of grains with a cubic crystal form and an average grain size of 0.15 μm.

Light-sensitive emulsion layer coating

First layer

The hydrazine compound II-30 (75 mg/m²), 5-methylbenzotriazole ($5\times10^3$ mol/Ag-mol), polyethyl acrylate latex (30 wt % relative to the gelatin) and 1,3-divinylsulfonyl-2-propanol (2.0 wt % relative to the gelatin) were added to light-sensitive emulsion C. The coated silver quantity was 3.5 g/m².

Second layer Gelatin(1.0 g/m²)

Third layer

5-Methylbenzotriazole ($5\times10^{-3}$ mol/Ag-mol), polyethyl acrylate latex (30 wt % relative to the gelatin), 1,3-divinylsulfonyl-2-propanol (2 wt % relative to the gelatin) and a redox compound of the present invention as noted in Table 3 were added to light-sensitive emulsion C and the resulting emulsion was coated to an amount to give a coated silver quantity of 0.4 g/m².

4th layer (protective layer)

A protective layer containing 1.5 g/m² of gelatin, 0.3 g/m² of polymethyl methacrylate particles (average particle diameter 2.5 μm) as a matt agent and, as coating assistants, the surfactants, stabilizer and ultraviolet ray absorber indicated below were coated and dried.

Surfactants

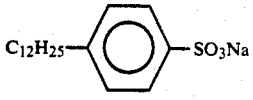

37 mg/m²

$CH_2COOC_6H_{13}$
|
$CHCOOC_6H_{13}$
|
$SO_3Na$ 37 mg/m²

$C_8F_{17}SO_2N(C_3H_7)CH_2COOK$ 2.5 mg/m²

-continued

Stabilizer

Thioctic acid 2.1 mg/m²

Ultraviolet absorber 100 mg/m²

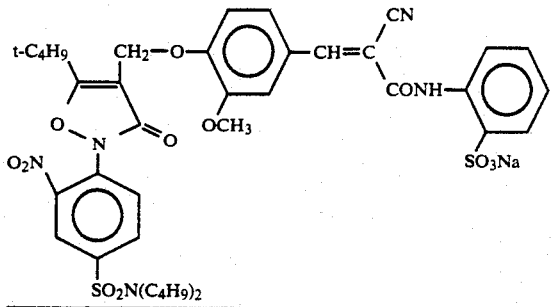

Using a Daylight Printer p-607 manufactured by Dainippon Screen Mfg. Co., Ltd., the samples were subjected to image exposure via original documents as shown in FIG. 1 and to 20 seconds development processing at 38° C. They were fixed, washed with water and dried, following which the letter image quality was assessed.

Letter image quality 5 is extremely good character letter quality and means that, when original documents such as in FIG. 1 are used and suitable exposure is effected such as to make 50% of the dot area 50% of the dot area on a light-sensitive material for contact work, characters 30 μm wide are reproduced. On the other hand, letter image quality 1 is a poor image quality and means that, when the same suitable exposure is effected, it is only possible to reproduce characters that are 150 μm or more wide. There are functional evaluation ratings 4–2 between 5 and 1. 3 or higher is the level at which material can serve for practical purposes. The results are shown in Table 3.

TABLE 3

| Sample | Redox Compound Type | Amount added (mol/m²) | Letter image quality |
|---|---|---|---|
| Comparative Example 6 | Comparative Compound B | $2.0\times10^{-5}$ | 3.0 |
| The Present Invention 3-1 | Compound No. 1 | " | 4.0 |
| The Present Invention 3-2 | Compound No. 5 | " | 4.0 |
| The Present Invention 3-3 | Compound No. 6 | " | 5.0 |
| The Present Invention 3-4 | Compound No. 7 | " | 5.0 |
| The Present Invention 3-5 | Compound No. 11 | " | 4.0 |
| The Present Invention 3-6 | Compound No. 12 | " | 4.0 |

As is clear from Table 3, the samples of the present invention have superior letter image quality.

Investigation of the photographic characteristics of exhausted solutions in the same way as in Example 2 showed that all the samples of the present invention were good.

While the invention has been described in detail and with reference to specific embodiments thereof, it will be apparent to one skilled in the art that various changes and modifications can be made therein without departing from the spirit and scope thereof.

What is claimed is:

1. A method for forming an image which comprises the step of developing an imagewise exposed silver halide photographic material which contains a redox compound, with a developer which contains a silver halide developing agent and at least 0.1 mol/l of a sulfite and has a pH of 9 to 12, wherein the redox compound contains a redox group which is a hydrazine derivative which is capable of releasing a nucleation development inhibitor, selected from the group consisting of a compound comprising one nitro group or a nitroso group;

a compound comprising a pyridine, a pyrazine, or a quinoline;

a compound comprising the N-halogen bond;

a quinone;

a tetraazolium compound;

an amine oxide;

an azoxy compound; and a coordination compound comprising an oxidation capability; as a result of oxidation with the oxidized developer, and wherein after said oxidation, at least a portion of said development inhibitor is released into a developer where it reacts with a developer component and changes into a compound having little inhibiting effect.

2. The method for forming an image of claim 1, wherein the redox compound is represented by formulae (I), (II) and (III):

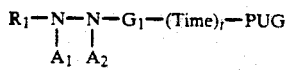

(I)

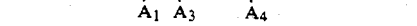

(II)

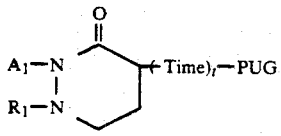

(III)

wherein $R_1$ represents an aliphatic group or an aromatic group;

$G_1$ represents a

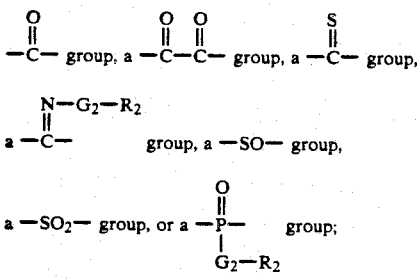

$G_2$ represents a single bond

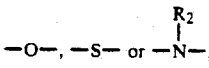

$R_2$ represents groups with the same definitions as for $R_1$ or a hydrogen atom, and if there is a plurality of $R_2$ groups in a molecule, they may be the same or different;

$A_1$ and $A_2$ each independently represents a hydrogen atom, an acyl group, an alkylsulfonyl group or an arylsulfonyl group provided that $A_1$ and $A_2$ are not both at the same time hydrogen atoms; $A_3$ represents groups with the same definitions as for $A_1$ or $—CH_2CH(A_4)—(Time)_t—PUG$;

$A_4$ represents a nitro group, a cyano group, a carboxyl group, a sulfonyl group or $—G_1—G_2—R_1$, and if there is a plurality of $—G_1—G_2—R_1$ groups in a molecule, they may be the same or different;

Time represents a divalent linking group;

t represents 0 or 1; and

PUG represents a nucleation development inhibitor which, when it flows out into a developer, can react with a developer component and change into a compound having little inhibiting effect.

3. The method for forming an image as in claim 2, wherein the photographic material further comprises a silver halide emulsion image forming layer or a hydrophilic colloid layer which contains a second hydrazine compound.

4. The method from forming an image as in claim 2, wherein the PUG comprises a nucleation development inhibitor possessing a nitro group or a compound having a pyridine skeleton.

5. A silver halide photographic material which comprises, (a) a redox compound which contains a redox group which is a hydrazine derivative which is capable of releasing a nucleation development inhibitor selected from the group consisting of a compound comprising one nitro group or a nitroso group;

a compound comprising a pyridine, a pyrazine, or a quinoline;

a compound comprising a N-halogen bond;

a quinone;

a tetraazolium compound;

an amine oxide;

an azoxy compound; and a coordination compound comprising an oxidation capability;

as a result of oxidation with an oxidized developer, wherein after said oxidation, at least a portion of said development inhibior is released into a developer where it reacts with a developer component and changes into a compound having little inhibiting effect, and (b) a second hydrazine compound.

6. The silver halide photographic material of claim 5, wherein the redox compound is represented by formulae (I), (II), and (III):

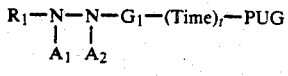

(I)

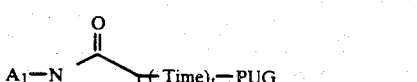

(II)

(III)

wherein $R_1$ represents an aliphatic group or an aromatic group;

$G_1$ represents a $-\overset{O}{\overset{\|}{C}}-$ group, a $-\overset{O}{\overset{\|}{C}}-\overset{O}{\overset{\|}{C}}-$ group, a $-\overset{S}{\overset{\|}{C}}-$ group, a $-\overset{N-G_2-R_2}{\overset{\|}{C}}-$ group, a $-SO-$ group, a $-SO_2-$ group, or a $-\overset{O}{\overset{\|}{\underset{\underset{G_2-R_2}{|}}{P}}}-$ group;

$G_2$ represents a single bond, $-O-$, $-S-$ or $-\overset{R_2}{\overset{|}{N}}-$;

$R_2$ represents groups with the same definitions as for $R_1$ or a hydrogen atom, and if there is a plurality of $R_2$ groups in a molecule, they may be the same or different;

$A_1$ and $A_2$ each independently represents a hydrogen atom, an acyl group, an alkylsulfonyl group or an arylsulfonyl group provided that $A_1$ and $A_2$ are not both at the same time hydrogen atoms; $A_3$ represents groups with the same definitions as for $A_1$ or $-CH_2CH(A_4)-(Time)_t-PUG$;

$A_4$ represents a nitro group, a cyano group, a carboxyl group, a sulfonyl group or $-G_1-G_2-R_1$, and if there is a plurality of $-G_1-G_2R_1$ groups in a molecule, they may be the same or different;

Time represents a divalent linking group;

t represents 0 or 1; and

PUG represents a nucleation development inhibitor which, when it flows out into a developer, can react with a developer component and change into a compound having little inhibiting effect.

7. The silver halide photographic material of claim 6, wherein the PUG comprises a nucleation development inhibitor possessing a nitro group or a compound having a pyridine skeleton.

8. A silver halide photographic material which comprises, (a) a layer for controlling image formation containing a redox compound which contains a redox group which is a hydrazine derivative which is capable of releasing a nucleation development inhibitor selected from the group consisting of a compound comprising one nitro group or a nitrogen group;

a compound comprising a pyridine, a pyrazine, or a quinoline;

a compound comprising a N-halogen bond;

a quinone;

a tetraazolium compound;

an amine oxide;

an azoxy compound; and a coordination compound comprising an oxidation capability;

as a result of oxidation with an oxidized developer, wherein after said oxidation, at least a portion of said development inhibitor is released into a developer where it reacts with a developer component and changes into a compound having little inhibiting effect, and (b) a silver halide emulsion image forming layer.

9. The silver halide photographic material of claim 8, wherein the redox compound is represented by formulae (I), (II), and (III):

$$R_1-\underset{\underset{A_1}{|}}{N}-\underset{\underset{A_2}{|}}{N}-G_1-(Time)_t-PUG \quad (I)$$

$$R_1-G_2-G_1-\underset{\underset{A_1}{|}}{N}-\underset{\underset{A_3}{|}}{N}-CH_2\underset{\underset{A_4}{|}}{CH}-(Time)_t-PUG \quad (II)$$

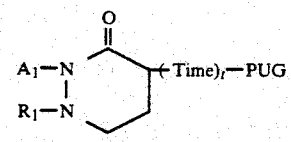

(III)

wherein $R_1$ represents an aliphatic group or an aromatic group; $G_1$ represents a $-\overset{O}{\overset{\|}{C}}-$ group, a $-\overset{O}{\overset{\|}{C}}-\overset{O}{\overset{\|}{C}}-$ group, a $-\overset{S}{\overset{\|}{C}}-$ group, a $-\overset{N-G_2-R_2}{\overset{\|}{C}}-$ group, a $-SO-$ group, a $-SO_2-$ group, or a $-\overset{O}{\overset{\|}{\underset{\underset{G_2-R_2}{|}}{P}}}-$ group;

$G_2$ represents a single bond, $-O-$, $-S-$ or $-\overset{R_2}{\overset{|}{N}}-$;

$R_2$ represents groups with the same definitions as for $R_1$ or a hydrogen atom, and if there is a plurality of $R_2$ groups in a molecule, they may be the same or different;

$A_1$ and $A_2$ each independently represents a hydrogen atom, an acyl group, an alkylsulfonyl group or an arylsulfonyl group provided that $A_1$ and $A_2$ are not both at the same time hydrogen atoms; $A_3$ represents groups with the same definitions as for $A_1$ or $-CH_2CH(A_4)-(Time)_t-PUG$:

$A_4$represents a nitro group, a cyano group, a carboxyl group, a sulfonyl group or $-G_1-G_2-R_1$, and if there is a plurality of $-G_1-G_2-R_1$ groups in a molecule, they may be the same or different;

Time represents a divalent linking group;

t represents 0 or 1; and

PUG represents a nucleation development inhibitor which, when it flows out into a developer, can react with a developer component and change into a compound having little inhibiting effect.

10. The silver halide photographic material of claim 9, wherein the PUG comprises a nucleation development inhibitor possessing a nitro group or a compound having a pyridine skeleton.

11. The silver halide photographic material of claim 6, wherein the redox compound is represented by formula (IV):

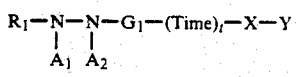

(IV)

wherein $R_1$ represents an aliphatic group or an aromatic group;

$G_1$ represents a

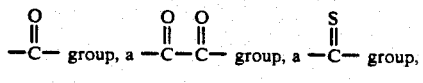

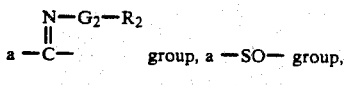

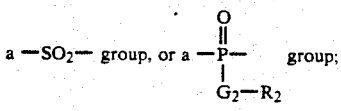

$G_2$ represents a single bond,

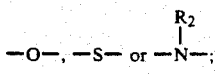

$R_2$ represents groups with the same definitions as for $R_1$ or a hydrogen atom, and if there is a plurality of $R_2$ groups in a molecule, they may be the same or different;

$A_1$ and $A_2$ each independently represents a hydrogen atom, an acyl group, an alkylsulfonyl group or an arylsulfonyl group provided that $A_1$ and $A_2$ are not both at the same time hydrogen atoms;

Time represents a divalent linking group;

t represents 0 or 1;

X represents a divalent group containing a nitro group as a substituent or a portion of a substituent or a divalent group possessing a pyridine ring in part of its structure; and Y represents a monovalent group which can react with a developer component and change into an anionic functional group.

* * * * *